US011331236B2

(12) United States Patent
Emerson et al.

(10) Patent No.: US 11,331,236 B2
(45) Date of Patent: May 17, 2022

(54) PATIENT TRANSFER DEVICE

(71) Applicant: CEGA Innovations, Inc., Sioux Falls, SD (US)

(72) Inventors: Aaron J. Emerson, Sioux Falls, SD (US); Ty A. White, Sioux Falls, SD (US); Matthew Rust, Hudson, WI (US); Hakeem Nizar, Sioux Falls, SD (US)

(73) Assignee: CEGA Innovations, Inc., Sioux Falls, SD (US)

( * ) Notice: Subject to any disclaimer, the term of this patent is extended or adjusted under 35 U.S.C. 154(b) by 290 days.

(21) Appl. No.: 16/144,744

(22) Filed: Sep. 27, 2018

(65) Prior Publication Data

US 2019/0091088 A1 Mar. 28, 2019

Related U.S. Application Data

(60) Provisional application No. 62/563,898, filed on Sep. 27, 2017.

(51) Int. Cl.
*A61G 7/10* (2006.01)

(52) U.S. Cl.
CPC ..... *A61G 7/1032* (2013.01); *A61G 7/1036* (2013.01); *A61G 7/103* (2013.01); *A61G 2200/16* (2013.01); *A61G 2200/32* (2013.01)

(58) Field of Classification Search
CPC ..... A61G 7/1032; A61G 7/1036; A61G 7/10; A61G 2200/16; A61G 2200/32
See application file for complete search history.

(56) References Cited

U.S. PATENT DOCUMENTS 5,101,519 A * 4/1992 Yamamoto ..... A61G 7/1019 5/942
5,390,379 A * 2/1995 Palmer, Jr. ..... A61G 7/1076 5/81.1 C
5,855,207 A * 1/1999 Moenning ..... A61G 7/1057 5/81.1 R (Continued)

FOREIGN PATENT DOCUMENTS

CN 105232271 A 1/2016
CN 105963094 A 9/2016

(Continued)

OTHER PUBLICATIONS

Written Opinion of the International Preliminary Examining Authority dated Aug. 30, 2019 in connection with International Patent Application No. PCT/US2018/053180, 5 pages.

(Continued)

*Primary Examiner* — Peter M. Cuomo
*Assistant Examiner* — George Sun
(74) *Attorney, Agent, or Firm* — Dorsey & Whitney LLP

(57) ABSTRACT

An apparatus for transferring a patient or other body comprises a housing, a deck at least partially disposed within the housing, and a continuous belt disposed about the deck. The housing is formed with first and second sides coupled to first and second ends, and a panel attached to the sides and ends to provide structural rigidity to the apparatus. The deck is coupled to the housing, and the continuous belt circulates around the deck to transfer a body from a first surface at a first side of the housing to a second surface at a second side of the housing.

22 Claims, 15 Drawing Sheets

(56) References Cited

U.S. PATENT DOCUMENTS

| | | | | |
|---|---|---|---|---|
| 8,683,626 | B1 * | 4/2014 | Kaczmarek | A61G 7/015 5/503.1 |
| 8,782,826 | B2 * | 7/2014 | White | A61G 7/1032 5/81.1 R |
| 9,101,521 | B2 | 8/2015 | White et al. | |
| 9,114,050 | B2 * | 8/2015 | White | A61G 7/1026 |
| 2001/0020304 | A1 * | 9/2001 | Roit | A61G 7/001 5/611 |
| 2006/0225202 | A1 * | 10/2006 | A. Stackley | A61G 7/1032 5/81.1 R |
| 2012/0304386 | A1 * | 12/2012 | Koh | A61G 7/1032 5/626 |
| 2014/0123384 | A1 * | 5/2014 | White | A61G 7/1032 156/60 |
| 2018/0019459 | A1 * | 1/2018 | Lobert | B60R 16/033 |

FOREIGN PATENT DOCUMENTS

| | | | |
|---|---|---|---|
| CN | 209253421 | U | 8/2019 |
| WO | 2005027814 | A1 | 3/2005 |

OTHER PUBLICATIONS

International Search Report and Written Opinion, International Patent Application No. PCT/US2018/053180, dated Nov. 29, 2018, pp. 1-146.

First Office Action dated Jan. 29, 2021 in connection with Chinese patent application No. 2018101541101, 12 pages including English translation.

* cited by examiner

PATIENT TRANSFER DEVICE

CROSS-REFERENCE TO RELATED APPLICATIONS

This application claims priority to U.S. Provisional Application No. 62/563,898, PATIENT TRANSFER DEVICE, filed Sep. 27, 2017, which is incorporated by reference herein, in the entirety and for all purposes.

FIELD

This disclosure relates generally to patient transport in hospital and clinical environments, and other medical or patient care settings. In particular, the disclosure relates to a patient transfer device for transferring a patient from one surface to another, for example between beds or gurneys in an operating room, or in an examination, laboratory, treatment, or recovery location.

BACKGROUND

In the day to day operations of a hospital, patients frequently are moved from one surface to another surface. In many instances, patients are not ambulatory and are moved via a gurney with the assistance of nursing and/or medical staff. For example, when a patient undergoes surgery, even an ambulatory patient may be rendered non-ambulatory by virtue of the operation and/or due to the effects of anesthesia or consequential conditions arising from or related to the procedure.

Non-ambulatory patients typically are moved via a gurney whenever there is a need to move a patient to a new area. For example, after surgery, the nursing and/or medical staff typically transfer the patient to a gurney for transport from the surgery room to the recovery room. Generally, the patient stays on the gurney while in the recovery room. Upon recovery, the patient is moved on the gurney to the hospital room. Once at the hospital room, the patient is moved from the gurney to the hospital bed by nursing and/or medical staff.

Some prior art devices used to move a patient are disclosed in U.S. Pat. Nos. 8,782,826; 9,101,521; and 9,114,050; all of which are assigned to the current applicant. The present disclosure discloses a device that provides improvements and/or alternatives to these prior art devices. In particular, the present design addresses achieving greater stability of the structure under the load of heavy patients (now more commonly encountered) and improvements to prevent contaminant intrusion and facilitate cleaning of the devices to reduce spread of infection.

SUMMARY

Various examples and embodiments described herein relate to a patient transfer device for transferring a patient or other body between surfaces, for example between beds, gurneys, or other locations in a hospital operating room, and in other clinical, laboratory, examination, treatment, transportation and recovery environments.

DETAILED DESCRIPTION

Figure 1A:
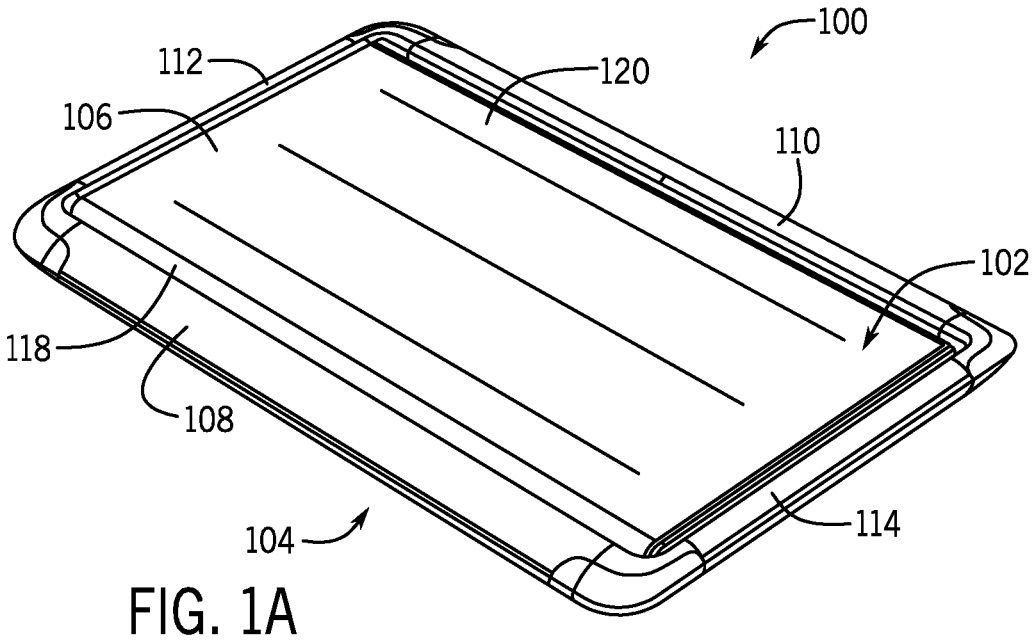
FIG. 1A is a perspective view of a transfer device, according to various embodiments of the present disclosure.
Figure 1B:
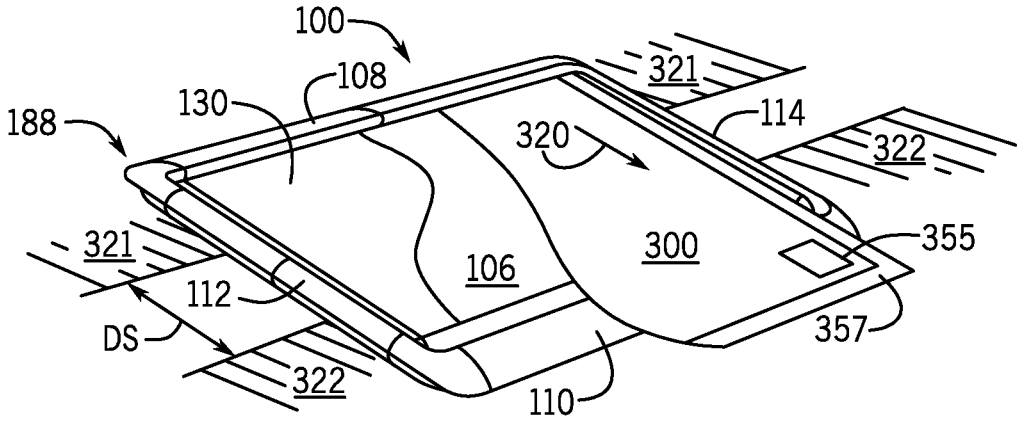
FIG. 1B is another perspective view showing a transfer device with a transfer sheet, positioned for use in a patient transfer.

FIG. 1A is a perspective view of a patient transport system, apparatus, assembly or device, 100 ("transfer device," for clarity and without limitation). FIG. 1B is an alternate perspective view, showing the transfer device 100 with a transfer sheet 300, positioned for use in a patient transfer.

The patient transport system or transfer device 100 includes a deck assembly 102 and a housing 104 for supporting the deck assembly 102. The deck assembly 102 includes a deck (see, e.g., deck 130 or 132 in FIGS. 16-18) and a continuous belt 106 routed around the deck for facilitating transfer of a patient from one surface to an adjacent surface. For example, the belt or webbing 106 may be movable relative to the housing 104 to facilitate transfer of a patient from one side of the housing 104 to an opposite side of the housing 104.

As shown in FIG. 1B, a sheet of material 300 (e.g., a disposable transfer sheet) may be positioned on top of and partially within the transfer device 100, with the device 100 extending across a gap or distance DS between a first patient supporting surface 321 and a second patient supporting surface 322, to which a patient is to be moved. The housing 104 may shield the sheet of material 300 from the underlying surfaces 321, 322 to ensure a clean removal of the sheet of material 300 from the housing 104 while conveying the patient from one surface to another surface. Removable attachment to the belt 106 allows the sheet of material 300 to travel with the belt and stay with the patient during transfer, while the deck assembly 102 (including the belt 106) and the housing 104 are removed post-transfer.

The sheet of material 300 may comprise an absorbent layer and also have a layer of material at its exposed edge 357 that can be grasped by persons performing a patient transfer. To set up a transfer, an edge of the sheet opposite exposed edge 357, which may have one or more underside patches of adhesive (comparable to underside patch 355 adjacent the exposed edge 357) may be placed across and adhered to the belt 106. Belt 106 is configured for bidirectional motion around opposed, spaced rollers 118, 120 (beneath belt 106 in FIG. 1A).

Once the sheet 300 is adhered to belt 106 and before the device is applied to the patient, belt 106 may be rotated to draw or insert a portion of the sheet 300 into the housing 104. Thereafter, the edge of the transport device 100 where the sheet 300 is inserted is placed under a patient resting on a starting surface 321 (typically by rolling the patient temporarily up on his/her side on the starting surface), so that upon rolling the patient back down a significant portion of the patient's weight comes to rest on the sheet 300 and underlying belt 106.

The movement of the patient may be initiated by a 'pushing' person (e.g., nursing and/or medical staff) on the side of patient closest to the starting surface 321 and finished by a 'puller' person (e.g., nursing and/or medical staff) on the side of the patient closest to the destination surface 322. The 'pushing' person may initiate patient transfer by applying force to the patient (e.g., the patient's side), and the 'pulling' person may grasp an edge of the sheet of material 300 on one side of the patient and pull the respective edge to move the patient across the transfer device 100 from the first (starting) surface 321 to a second (destination) surface 322, for example from an operating table or laboratory or examining station to a bed or gurney.

The belt 106 may convey a patient on the sheet 300 by following the movement of the sheet of material 300 in a direction shown by arrow 320, opposite the belt motion direction for insertion of sheet 300, to effect patient transfer to destination surface 322. The sheet of material 300 may be reinforced in full, or in part, to provide optional post-transfer convenience to staff by providing targeted material integrity to boost or otherwise adjust the patient's position on a bed surface, for example. The transfer device 100 may inhibit initiation of patient transfer by pulling, by limiting the pull strength of the edge where pulling may occur, thereby protecting the puller (i.e., moving a load located away from the puller may transfer load/stress to the puller's shoulders and backs, which are areas of common and expensive injury risk).

Figure 2:
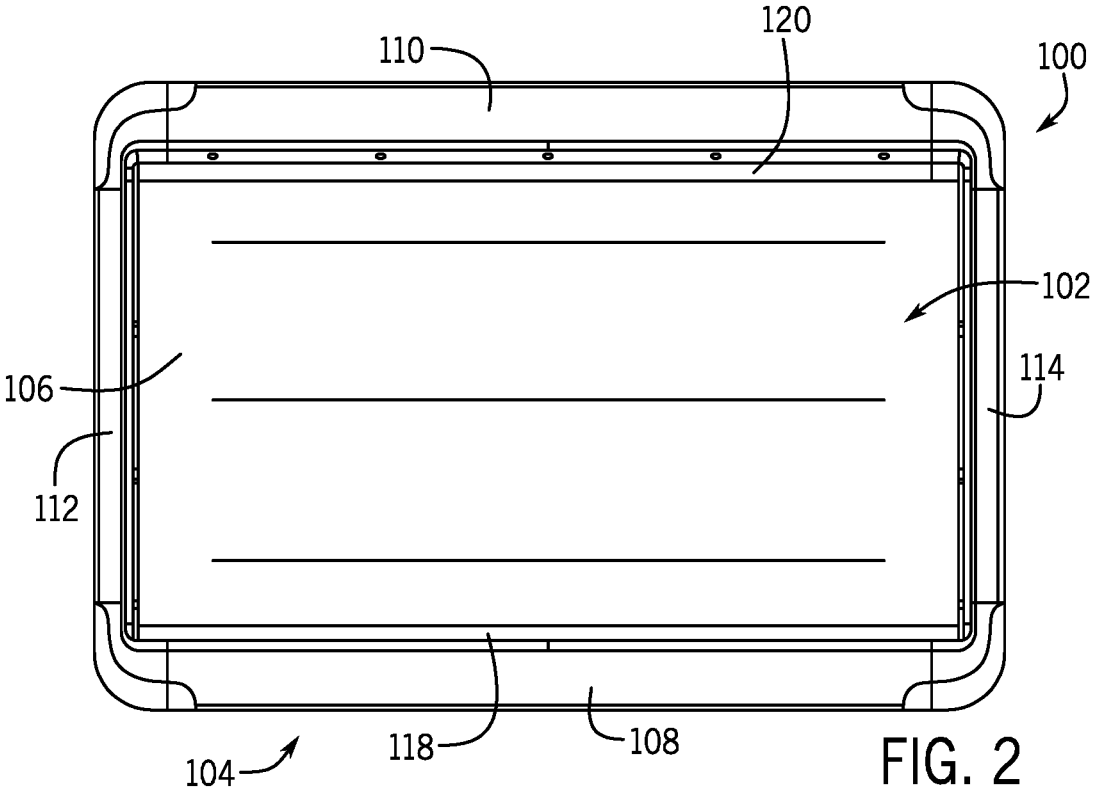
FIG. 2 is a top view of the transfer device, according to the embodiment of FIG. 1.
Figure 3:
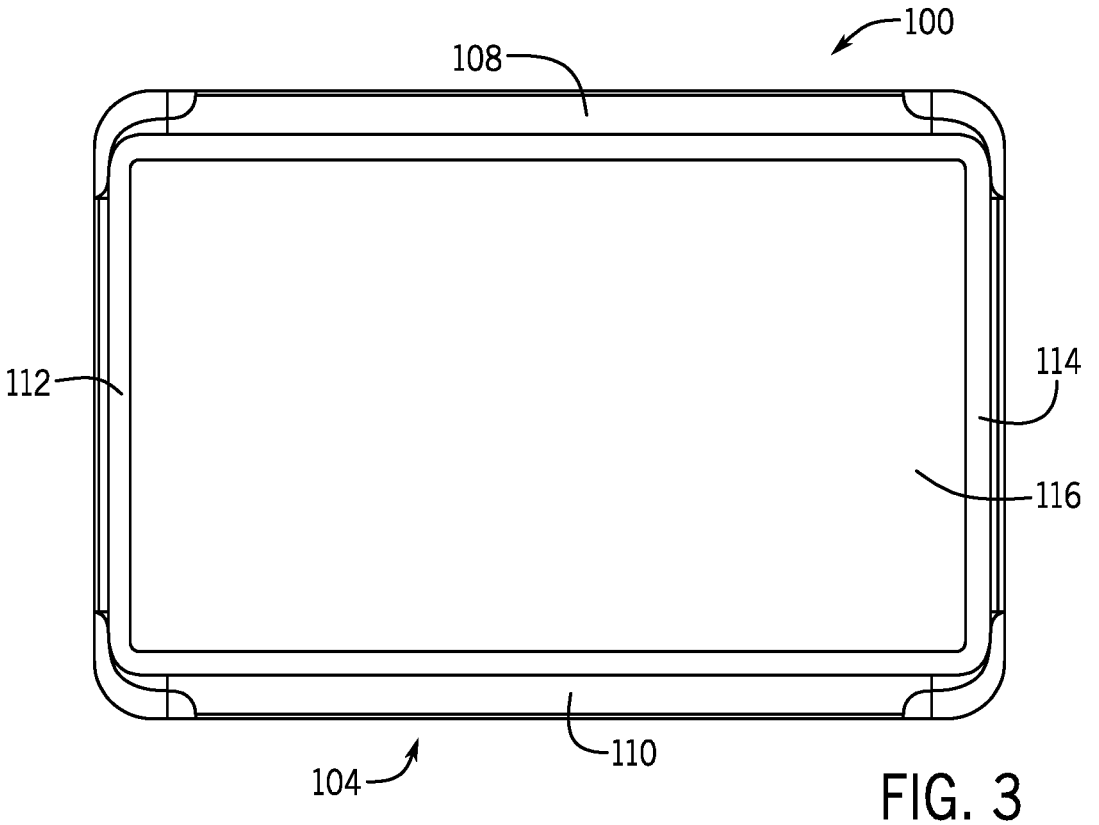
FIG. 3 is a bottom view of the transfer device, according to the embodiment of FIG. 1.

FIG. 2 is a top view of the transfer device 100. FIG. 3 is a bottom view of the transfer device 100. Now referring to FIGS. 1-3, the transfer device 100 will be further described.

The housing 104 generally is dimensioned to span a distance DS between the first surface and the second surface. The housing 104 includes a first elongated side frame (or frame member) 108, a second elongated side frame (or frame member) 110, a first elongated end frame (or frame member) 112, and a second elongated end frame (or frame member) 114. The end frame members 112, 114 attach to the side frame members 108, 110 to form a peripheral structure of the housing 104, and a panel 116 spans between and attaches to the frame members 108, 110, 112, 114 to form a bottom of the housing 104.

Generally, the side frame members 108, 110 extend along a height dimension of a patient, and the end frame members 112, 114 extend across the distance between the first surface and the second surface. The housing 104 is made sufficiently strong so as to have the strength to not fail while spanning the distance between the first surface and the second surface. The housing 104 may include a contoured edge region having converging top and bottom slopes selected for ergonomic interaction with a patient in transfer thereof from a first surface to a second surface.

The deck assembly 102 may include a first elongated roller 118 positioned beneath belt 106 along one side of a deck structure (e.g., deck 130 or 132 in FIGS. 16-18) near the first elongated frame member 108 of the housing 104, and a second elongated roller 120 positioned beneath belt 106 along another opposing side of the deck near the second elongated frame member 110 of the housing 104. Alternatively, a roller-less deck assembly 102 may be provided, with low-friction bearing surfaces replacing one or both rollers 118, 120.

Figure 4:
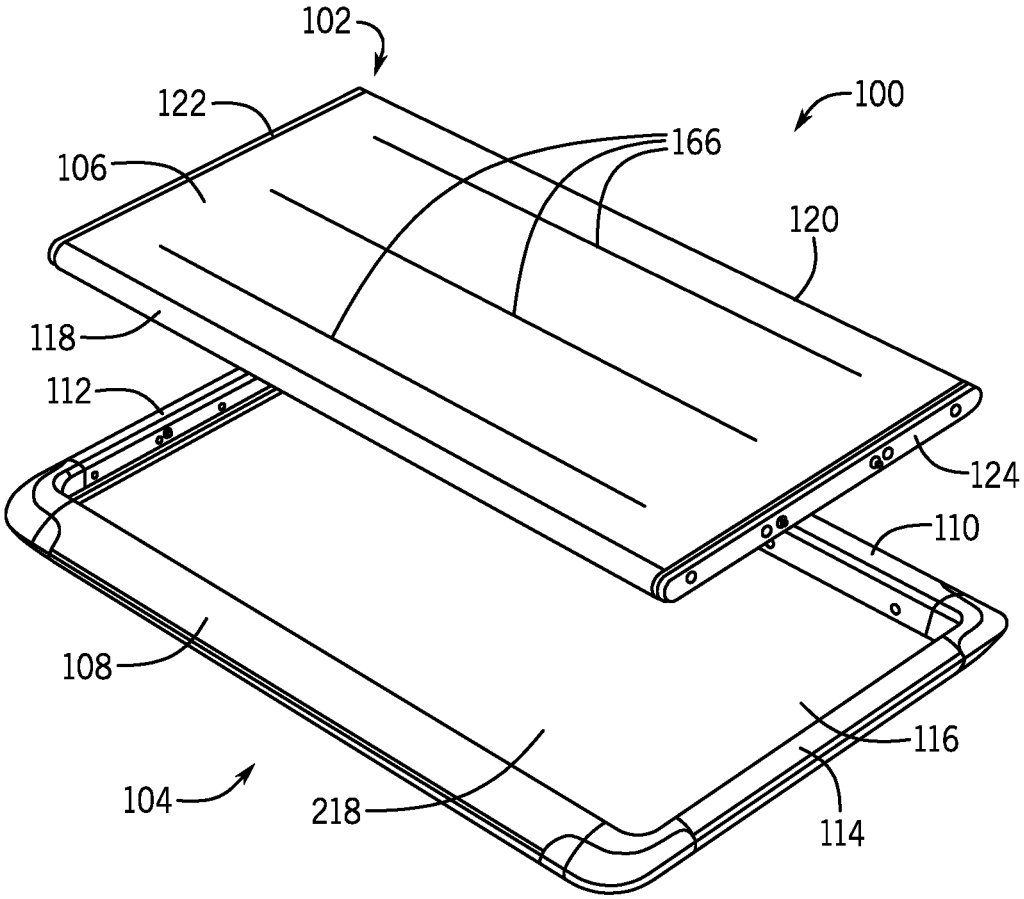
FIG. 4 is an exploded view of the transfer device, according to the embodiment of FIG. 1.

FIG. 4 is an exploded view of the transfer device 100, e.g., according to the embodiment of FIG. 1. As shown in FIG. 4, the continuous belt 106 fits over the rollers 118, 120 such that the belt 106 is positioned in conveying relation with respect to the rollers 118, 120.

A pair of connector plates 122, 124 may be attached to respective ends of the elongated rollers 118, 120 and the deck such that the rollers 118, 120 are rotatable relative to the connector plates 122, 124 and the deck. The connector plates 122, 124 generally maintain the rollers 118, 120 spaced apart and parallel to one another. One of the connector plates 122 is attachable to first end frame member 112 and the other connector plate 124 is attachable to the second end frame member 114, thereby attaching the deck assembly 102 to the housing 104. The connector plates 122, 124 may include a hold/release mechanism allowing removal of the deck assembly 102 from the housing 104 for cleaning, for example.

The first and second rollers 118, 120 and the deck (e.g., deck 130, 132 in FIGS. 16-18) are positioned within the continuous belt 106. A portion of the continuous belt 106 conveys a patient across the transfer device 100 while the remaining portion of the continuous belt 106 passes between the housing 104 and the deck. By passing between the housing 104 and the deck, the continuous belt 106 does not contact the first surface or the second surface that a patient is transferred from or to, respectively, thereby reducing cross-contamination of material between the first and second surfaces.

Note that the designations of first and second side frames (or frame members) 108, 110 of housing 104 are arbitrary, as are the designations of first and second end frames (or frame members) 112, 114 and the first and second rollers 118, 120. Any or all of these designations may be interchanged or reversed, without loss of generality. For example, deck assembly 102 may be configured to transfer a patient in either direction, from first side frame member 108 to second side member 110 of housing 104, or from second side member 110 to first side member 108. Housing 104 can also be rotated in either a horizontal or vertical plane, or both, for example to exchange the respective locations of first and second side frame members 108, 110 with respect to first and second surfaces, and/or to exchange the locations of first and second end frame members 112, 114.

In contrast to roller boards and other existing systems, for example, the patient transfer system remains substantially stationary across the gap DS between the first surface and second surface during the transfer process, lowering the risk of cross-contamination from the first surface to the second surface, and reducing the number of required patient manipulations. During the transfer process, the weight of the patient is supported by the deck assembly 102, for example with vertical (gravitational) loading transferred from the patient body through belt 106 onto the deck (e.g., deck 130, 132 in FIGS. 16-18) and thence to the first surface and/or second surface. The deck assembly 102 is isolated from the first and second surfaces by the housing 104, reducing the risk of cross-contamination of materials from the first surface to the second surface. This "spaced" or "isolated" patient transfer configuration also reduces the number of manipulations required in each patient transfer, as compared to other devices.

Reversible Deck

Figure 16:
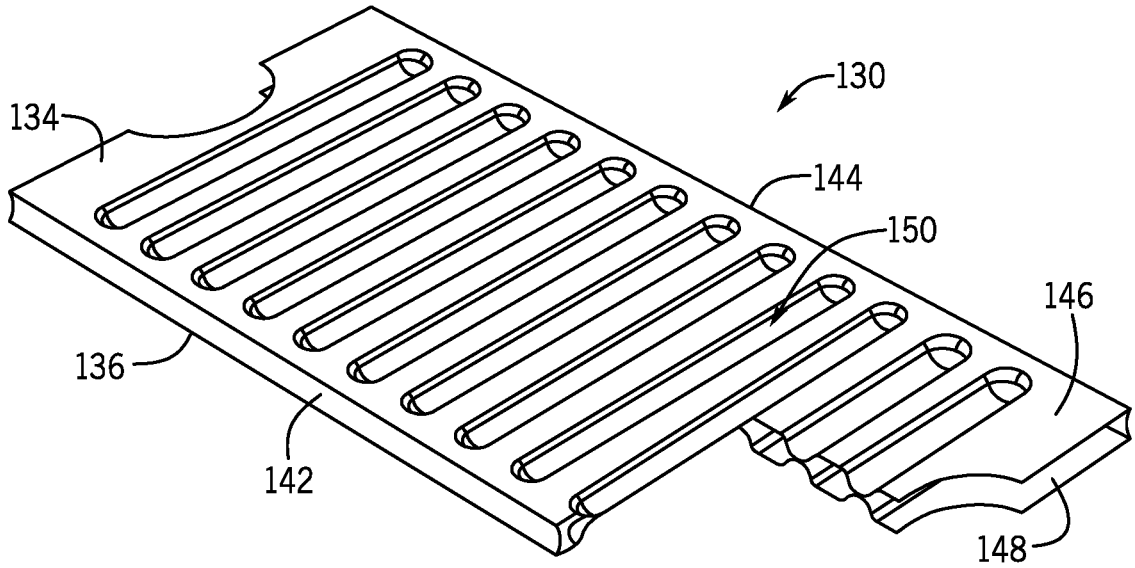
FIG. 16 is a perspective, partial cutaway view of a deck of the transfer device, according to the embodiment of FIG. 1.
Figure 17:
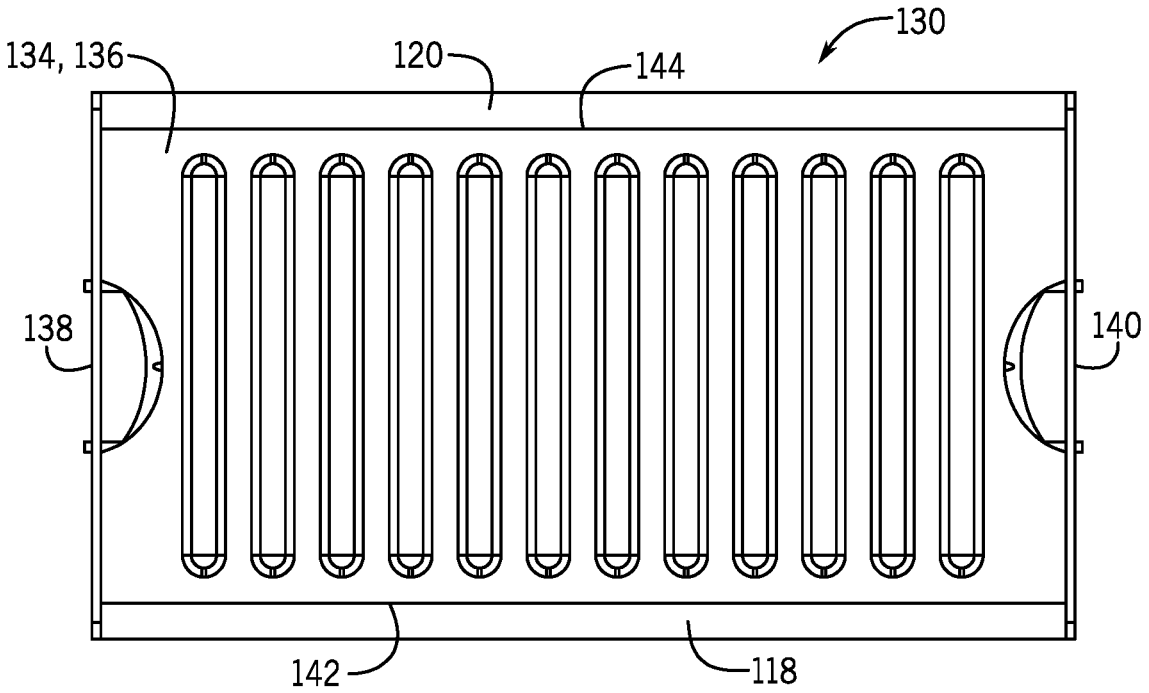
FIG. 17 is a top plan view of the deck, according to the embodiment of FIG. 16.
Figure 18:
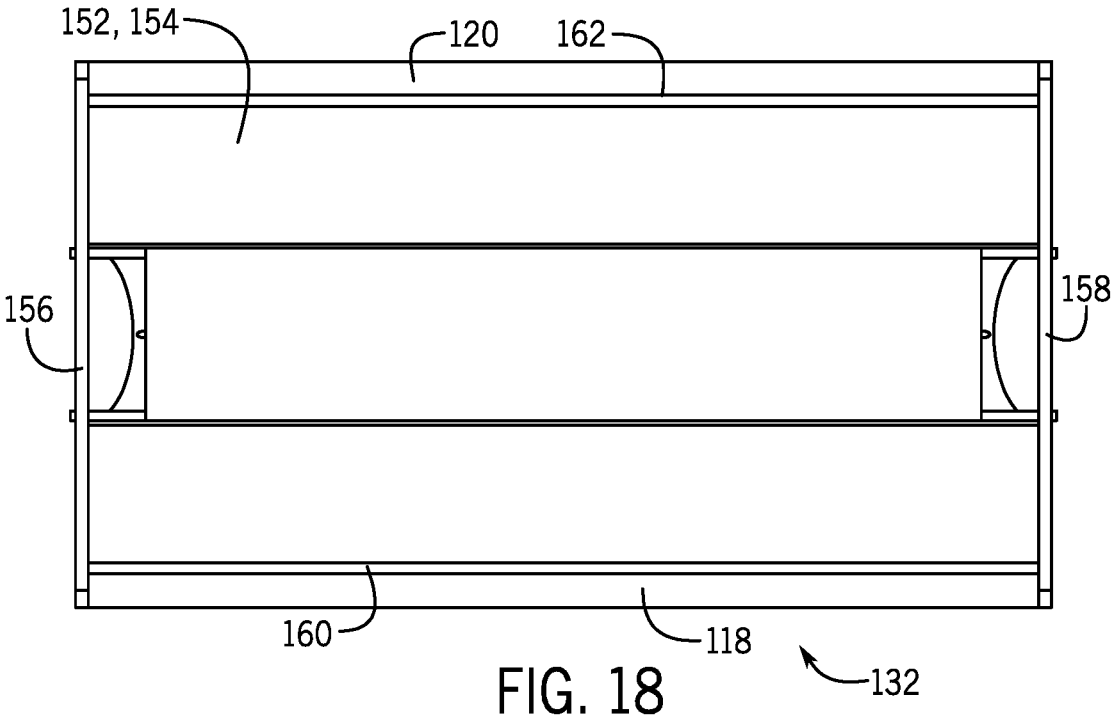
FIG. 18 is a top plan view of a deck of the transfer device, according to an alternate embodiment of the present disclosure.

FIG. 16 is a perspective, partial cutaway view of a deck 130 of the transfer device 100, e.g., according to the embodiment of FIG. 1. FIG. 17 is a top plan view of the deck 130, e.g., according to the embodiment of FIG. 16. FIG. 18 is a top plan view of a deck 132 of the transfer device, according to an alternate embodiment of the present disclosure.

Referring to FIGS. 16-18, a support deck 130 (FIGS. 16, 17, and FIGS. 22-24) and an alternative support deck 132 (FIG. 18) are illustrated. The decks 130, 132 are configured to be positioned within the continuous belt 106 and received at least partially or fully within the housing 104. The decks 130, 132 are coupled to the first and second elongate frame members 112, 114 via the connection plates 122, 124, respectively. The decks 130, 132 are configured to support a patient or other body during transfer from one side of the housing 104, across the deck, and to an opposite side of the housing 104.

The decks 130, 132 may be configured to be reversible. For example, the decks 130, 132 may have identical surfaces on both sides of each respective deck 130, 132, such that the decks 130, 132 may be placed into the housing 104 with either side externally facing without consequence to the transfer device 100 or patient, thereby increasing the life of the transfer device 100 and its components. By designing the decks 130, 132 as reversible, the decks 130, 132 eliminates a possible error of placing a deck upside-down in the housing 104, e.g., after the deck has been removed from the housing 104 for cleaning the housing 104 and deck or belt.

The dual-sided decks 130, 132 also prevent uncontemplated wear on the belt 106 caused by placing an orientation-specific deck upside-down in the housing 104, thus increasing the life of the belt 106 and presenting a high quality image to the customer. Both the upper and lower surfaces of the decks 130, 132 may have a low friction surface finish (e.g., a selected polymer or optimized thermoplastic maerial), texture, or covering (e.g., nylon impregnated with TEFLON® or silicone material) to reduce static and dynamic coefficients of friction between the deck and encircling belt 106.

FIG. 16 is a perspective, partial cutaway view of a deck 130 of the transfer device, e.g., according to the embodiment of FIG. 1. FIG. 17 is a top plan view of the deck 130, e.g., according to the embodiment of FIG. 16. Referring to FIG. 17, a top plan view of the deck 130 is illustrated.

Figure 22:
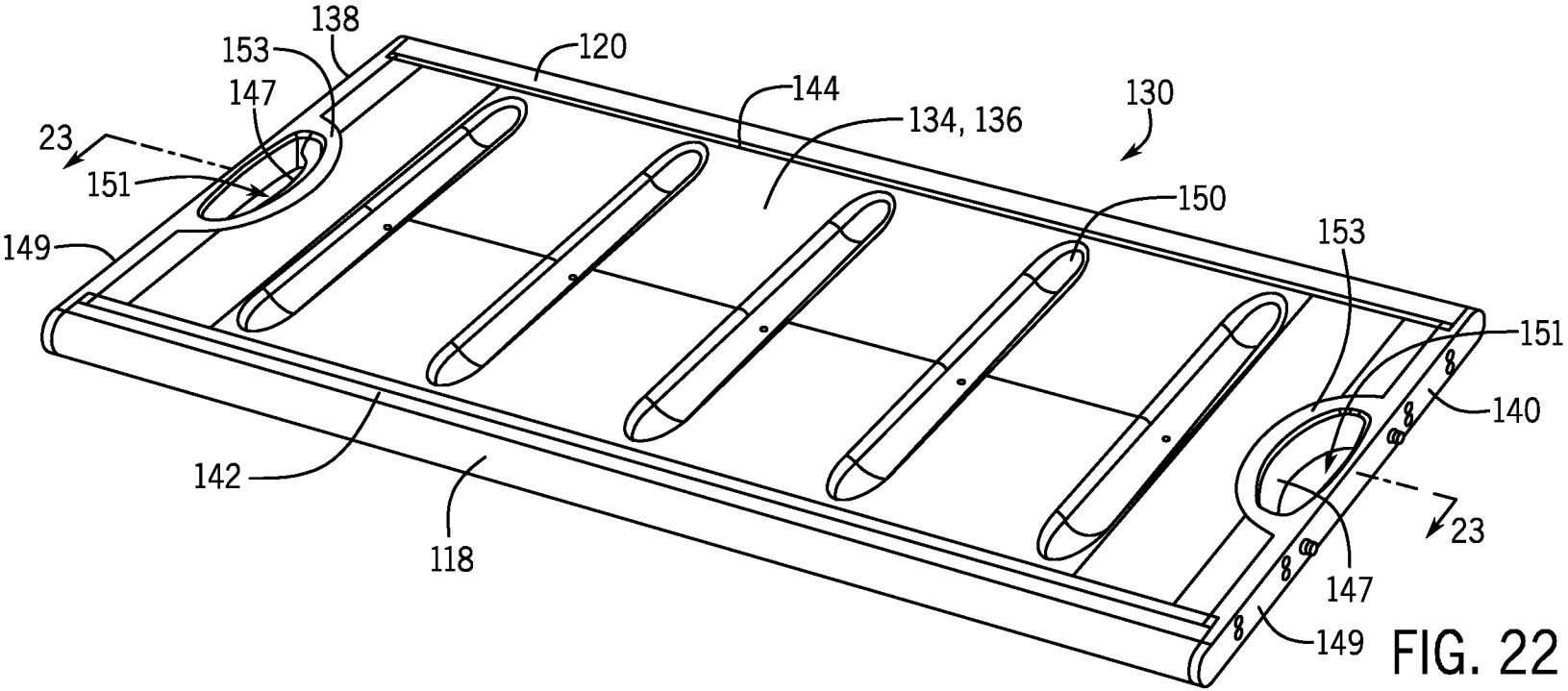
FIG. 22 is a perspective view of a deck of the transfer device, according to the embodiment of FIG. 17, with fewer ribs.

FIG. 22 is a perspective view of a deck 130 of the transfer device, e.g., according to the embodiment of FIG. 17, with fewer ribs 150. Referring to FIG. 22, a perspective view of the deck 130 is illustrated.

The bottom plan view of the deck 130 is similar or substantially identical to the top plan view of the deck 130. The opposing major surfaces 134, 136 of the deck 130 are similar, symmetric or substantially identical, and the deck 130 can be installed in the housing 104 in either orientation, with either major surface 134, 136 facing outwardly from the housing 104. The top and bottom major surfaces of the deck are substantially symmetric accordingly.

The deck 130 includes opposing ends 138, 140 for attachment to the connection plates 122, 124, respectively, and/or to the end frame members 112, 114 of the housing 104. The deck 130 includes opposing sides 142, 144 for placement adjacent elongated rollers 118, 120. Similar to the major surfaces 134, 136 of the deck 130, the ends 138, 140 may be similar, symmetric or substantially identical to one another and the sides 142, 144 may similar, symmetric or substantially identical such that installation of the deck 130 into the housing 104 is not orientation-specific, and deck 130 can be installed with opposing surfaces 134, 136, ends 138, 140 and sides 142, 144 in either orientation. The deck 130 is configured to be received inside the belt 106 such that belt 106 extends along the major surfaces 134, 136 and wraps around the rollers 118, 120 disposed along the sides 142, 144 of the deck 130.

Figure 23:
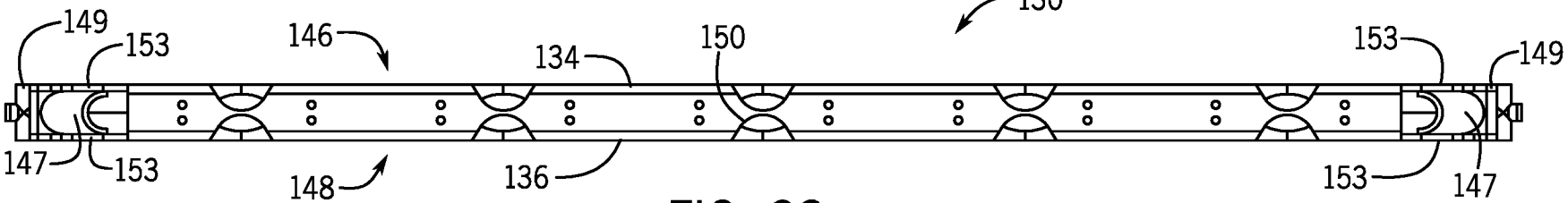
FIG. 23 is a cross-sectional view of a deck of the transfer device, according to the embodiment of FIG. 22 and taken along line 23-23 in FIG. 22.
Figure 24:
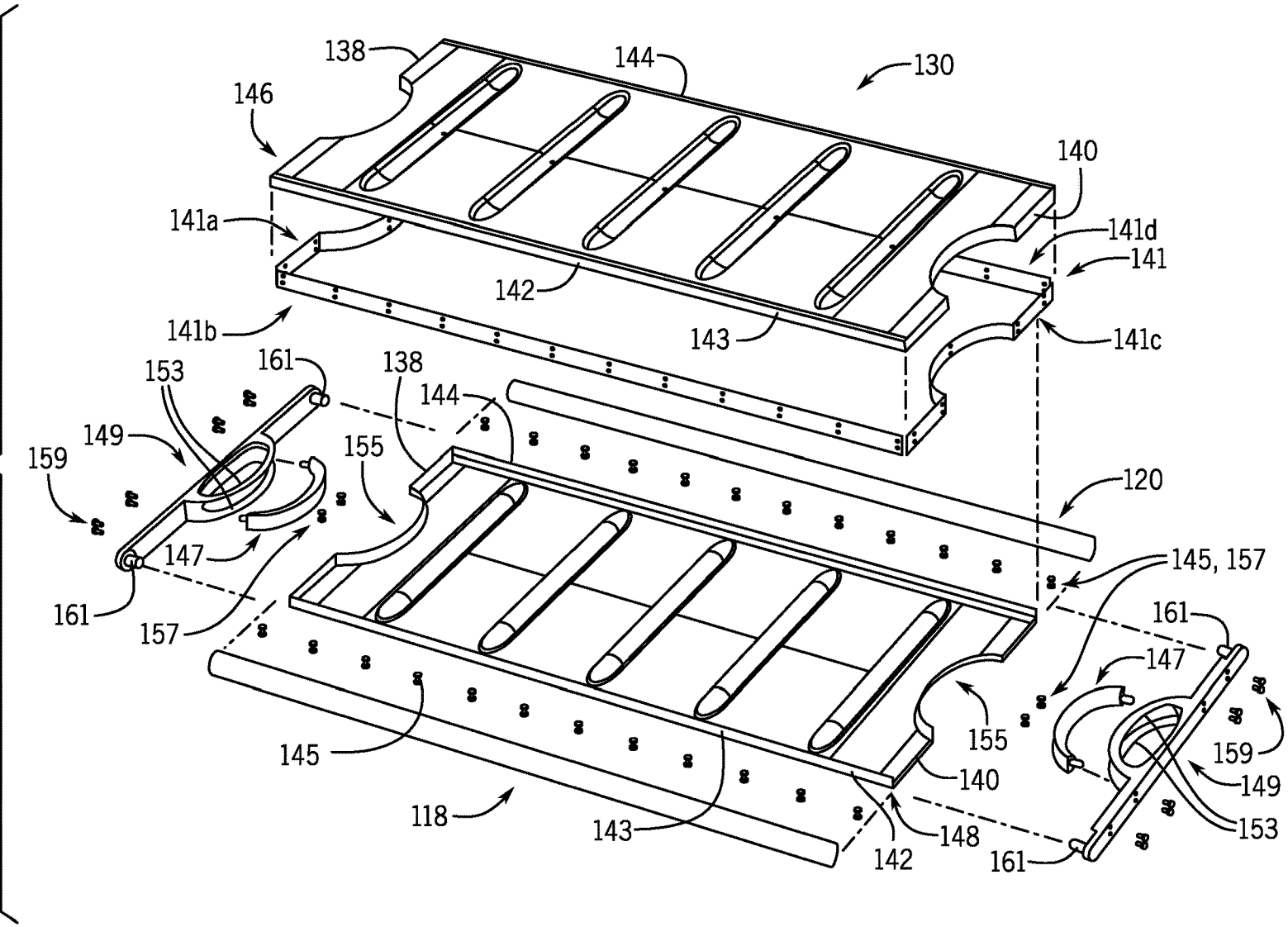
FIG. 24 is an exploded, perspective view of a deck of the transfer device, according to the embodiment of FIG. 22.

FIG. 23 is a cross-sectional view of a deck 130 of the transfer device, e.g., according to the embodiment of FIG. 22 and taken along line 23-23. FIG. 24 is an exploded, perspective view of the deck 130 of the transfer device, e.g., also according to the embodiment of FIG. 22.

Referring to FIGS. 16 and 23, the deck 130 may be made with two identical pressure-formed panels 146, 148 with integrated ribs 150, which provide stiffness to the major surfaces 134, 136 and generally the structure of the deck 130.

As illustrated in FIG. 23, the ribs 150 of each panel 146, 148 may project inwardly from their respective major surfaces 134, 136, such that the major surfaces 134, 136 are substantially planar to facilitate patient transfer, and the ribs 150 increase the stiffness of the major surfaces 134, 136. In this fashion, the ribs 150 increase the stiffness of the major surfaces 134, 136 without increasing the overall profile of the deck 130.

The ribs 150 of the panels 146, 148 may be aligned with one other such that the adjacent ribs 150 abut against each other to further increase the stiffness of the major surfaces 134, 136. The adjacent ribs 150 may abut against each other along a midline of the deck 130 positioned equidistant between the major surface 134, 136 of the panels 146, 148, respectively. The number of ribs 150 per panel 146, 148 may vary depending on the application. For example, each panel 146, 148 may include five ribs 150 as illustrated in FIGS. 22-24, twelve ribs 150 as illustrated in FIGS. 16 and 17, or other numbers of ribs 150 as needed to provide a desired amount of stiffness to the major surfaces 134, 136.

The pressure-formed panels 146, 148 enable a reduction in the weight of the deck 130, thereby decreasing the overall weight of the transfer device 100. Each panel 146, 148 may be formed with any aluminum alloys, magnesium alloys, or any other structurally strong metals, alloys, or plastics/polymers, for example. The panels 146, 148 may be attached together to create a strong, dual-sided deck body 130. For example, the adjacent ribs 150 (see FIG. 23) may be attached together (e.g., welded, riveted, or otherwise secured together) to secure the panels 146, 148 together. Additionally or alternatively, the perimeter of the panels 146, 148 may be joined together, such as by an external cap or an internal wall system.

Referring to FIG. 24, an exploded view of the deck 130 according to one embodiment is illustrated. As illustrated in FIG. 24, a joining band 141 may connect the panels 146, 148 together. The joining band 141 may be formed as a single, unitary component, or may be formed of separate sections 141*a*, 141*b*, 141*c*, 141*d* as illustrated in FIG. 24 for connecting the respective sides and ends of the panels 146, 148 together. For example, first and second joining bands 141*a*, 141*c* may be used to connect respective ends 138, 140 of the panels 146, 148 together, and third and fourth joining bands 141*b*, 141*d* may be used to connect respective sides 142, 144 together.

Each panel 146, 148 may include an inwardly-turned peripheral flange 143 configured to facilitate attachment of the joining band 141 to the panels 146, 148. The peripheral flange 143 may extend continuously or discontinuously around the perimeter of each panel 146, 148. The panels 146, 148 and joining band 141 may be attached together via fasteners, such as the illustrated rivets 145.

With continued reference to FIG. 24, the deck 130 may include handling features to facilitate users (e.g., nurses and/or medical staff) in moving the deck 130. For example, as illustrated in FIG. 22, the deck 130 may include a handle 147 located proximate each end 138, 140 of the deck 130. Respective end rails 149 may at least partially secure the handle 147 in place, and respective apertures 151 may be defined between the respective handles 147 and end rails 149 to accommodate a user's hand. Each handle 147 may be curved, and the ends of each handle 147 may be attached to a respective end rail 149 in various manners, such as snap-fit into receiving holes defined in the end rails 149.

The end rails 149 may include guards 153 extending along the sides of the handles 147 to inhibit ingress of contaminants through the interface between the handles 147 and the panels 146, 148. The guards 153 may be substantially flush with the major surfaces 134, 136 of the panels 146, 148 (see FIG. 23) so as to not interfere with movement of the belt around the surfaces 134, 136. The guards 153 may at least partially circumscribe the apertures 151.

Referring to FIG. 24, each handle 147 may be received in a substantially semi-circular cutout 155 defined in the ends 138, 140 of the panels 146, 148. The handles 147 may be attached to the ends of the panels 146, 148 in various manners, such as via the rivets 157 illustrated in FIG. 24.

The end rails 149 may extend along each respective end 138, 140 of the deck 130. The end rails 149 may be attached to the ends 138, 140 of the panels 146, 148 in various manners, such as via the screws 159 illustrated in FIG. 24. When attached to the panels 146, 148 (see FIG. 22), the end rails 149 may function as an end cap to seal the ends of the panels 146, 148 from contamination, and the handles 147 may be visible through the apertures 151.

The end rails 149 may rotationally support the rollers 118, 120 alongside each side 142, 144 of the deck 130. For example, as illustrated in FIG. 24, each end rail 149 may include two inwardly-projecting posts 161 onto which ends of the rollers 118, 120 are mounted and rotate about during circulation of the belt around the deck 130. The posts 161 on each respective end rail 149 may be spaced apart from each other a sufficient distance that permits positioning of the panels 146, 148 between the rollers 118, 120 with a clearance gap between the rollers 118, 120 and the sides 142, 144 of the deck 130.

To assemble the deck 130, the panels 146, 148 may be connected together, such as via rivets 145, spot welding, and/or other fastening methods. The handles 147 may be connected to the ends of the panels 146, 148, such as via rivets 157, spot welding, and/or other fastening methods. Then, the end rails 149 may be connected to the ends of the panels 146, 148, such as via screws 159, rivets, spot welding, and/or other fastening methods.

During connection of the end rails 149 to the panels 146, 148, the rollers 118, 120 may be aligned with the posts 161 on the end rails 149 such that the rollers 118, 120 are rotationally mounted onto the posts 161 when the end rails 149 are connected to the panels 146, 148. Also during connection of the end rails 149 to the panels 146, 148, the handles 147 may be received between the guards 153 on each end rail 149, and the handles 147 may be connected to the respective end rail 149, such as via a snap-fit connection between ends of the handles 147 and the end rails 149.

Relative to existing patient transfer devices, the deck 130 provides faster assembly, less hardware, and fewer parts. The deck 130 is lighter weight than decks for existing patient transfer devices, includes no exposed hardware, includes a unified frame and panels, and includes no internal frame pieces. The deck 130 may include a riveted perimeter seam to provide fast assembly of the panels 146, 148.

Referring back to FIG. 18, a top plan view of the deck 132 is illustrated. The bottom plan view of the deck 132 is identical to the top plan view of the deck 132, and thus the bottom plan view is omitted. The opposing major surfaces 152, 154 of the deck 132 are similar, symmetric or substantially identical to one other, and thus the deck 132 can be installed in the housing 104 in either orientation, with either major surface 152, 154 facing outwardly from the housing 104. The deck 132 includes opposing ends 156, 158 for attachment to the connection plates 122, 124, respectively, and/or to the end frames 112, 114 of the housing 104. The deck 132 includes opposing sides 160, 162 for placement adjacent elongated rollers 118, 120.

Similar to the major surfaces 152, 154 of the deck 132, the ends 156, 158 may be similar, symmetric or substantially identical to one other and the sides 160, 162 may be similar, symmetric or substantially identical such that installation of the deck 132 into the housing 104 is not orientation-specific, and deck 132 can be installed with opposing surfaces 152, 154, ends 156, 158 and sides 160, 162 in either orientation. The deck 132 is configured to be received inside the belt 106 such that belt 106 is extends along the major surfaces 152, 154 and wraps around the rollers 118, 120 disposed along the sides 160, 162 of the deck 132. The deck 132 may be extruded or have other structures disclosed herein.

Referring back to FIGS. 16 and 17, the deck 130 does not have any hardware on its top and bottom major surfaces 134, 136. Similarly, referring to FIG. 18, the deck 132 does not have any hardware on its top and bottom major surfaces 152, 154. Eliminating surface hardware provides a smooth, consistent surface to improve the performance and life of the belt 106 and increase comfort for the patient.

Distance Between Rollers and Deck

Figure 19:
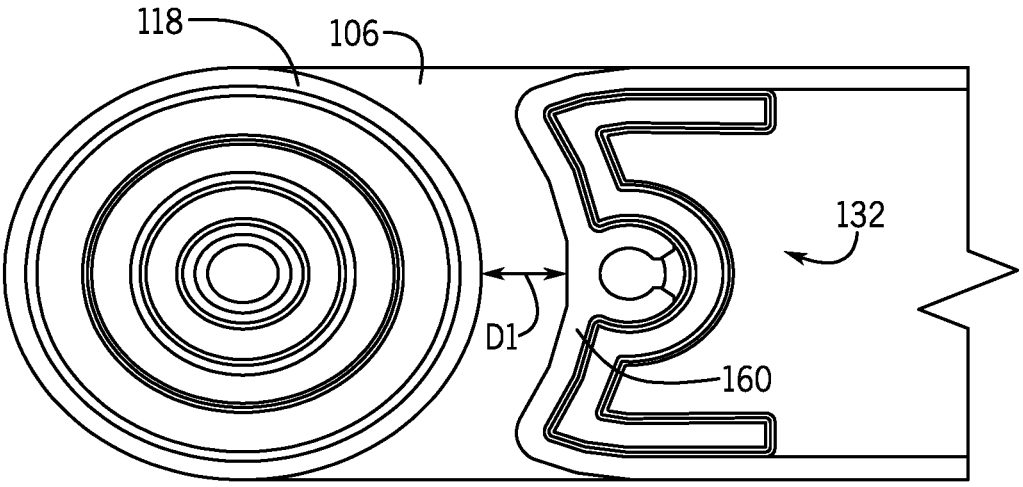
FIG. 19 is a detail, cross-sectional view of a belt wrapped around a roller and a deck, according to the embodiment of FIG. 1.

FIG. 19 is a detail, cross-sectional view of a belt 106 wrapped around a roller 118 and a deck 132, e.g., according to the embodiment of FIG. 1. The distance between the rollers 118, 120 and the sides of the deck (e.g., sides 142, 144 of deck 130 illustrated in FIGS. 16-17 or sides 160, 162 of deck 132 illustrated in FIG. 18) may be increased relative to existing similar transfer devices.

Referring to FIG. 19, roller 118 is separated from deck 132 by distance D1. More specifically, distance D1 is defined between an outer surface of the roller 118 and the deck 132. Distance D1 is dimensioned to reduce the possible contact between the roller 118 and the side 160 of the deck 132 due to excess deflection of the deck 132 of the housing. In some embodiments, distance D1 is at least 2.5 mm.

Although only roller 118 and side 160 are illustrated in FIG. 19 for the sake of simplicity, roller 120 similarly is separated from side 162 of deck 132 by distance D1. Likewise, when deck 130 is used, roller 118 is separated from side 142 by distance D1, and roller 120 is separated from side 144 by distance D1. Thus, rollers 118, 120 remain free to rotate without interference from the sides of the decks 130, 132 during patient transfer due to distance D1.

Depending on the amount of deflection of the rollers 118, 120 and adjacent housing, other actions may be taken to aid in maintaining adequate distance D1. Specifically, the first and second elongated rollers may be spaced from the opposing sides of the deck by a tolerance that increases from opposing ends of the deck to a middle portion thereof, the tolerance selected to maintain clearance for flexing of the rollers and/or housing in transferring the patient from the first surface to the second surface on the continuous belt.

Belt

Figure 20:
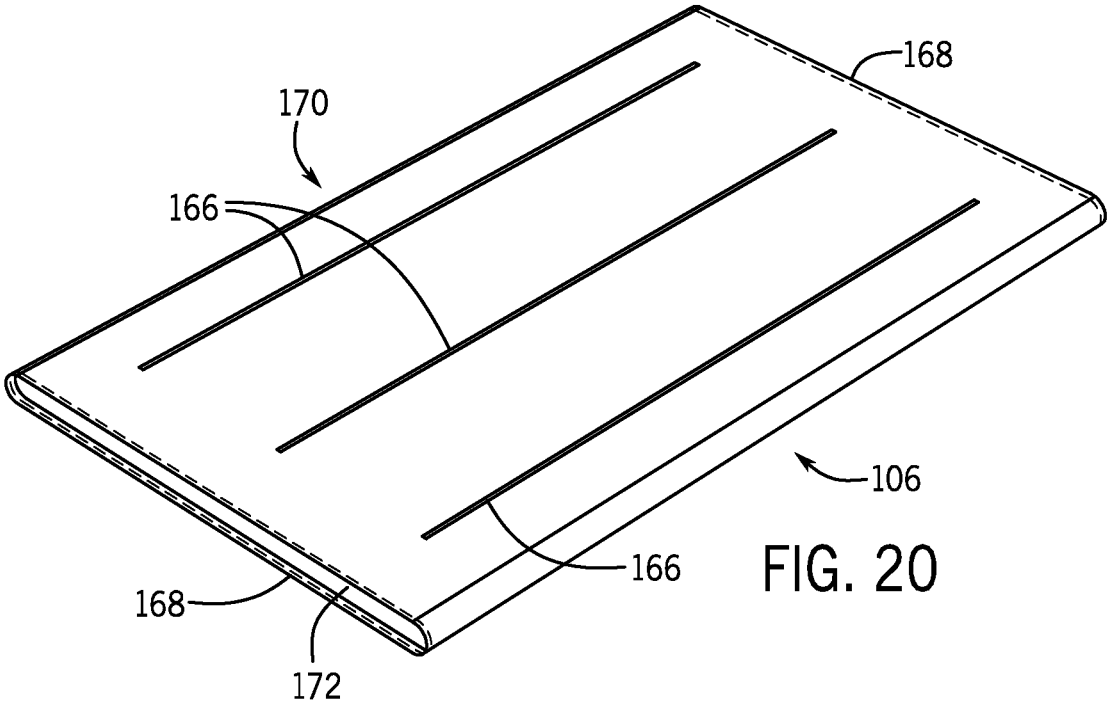
FIG. 20 is a perspective view of a continuous belt of the transfer device, according to the embodiment of FIG. 1.

FIG. 20 is a perspective view of a continuous belt 106 of the transfer device, e.g., according to the embodiment of FIG. 1. Referring to FIG. 20, a perspective view of the continuous belt 106 is shown. The belt 106 may include one or more visual alignment guide lines 166 to facilitate loading of a disposable transfer sheet onto the belt 106 and insertion into the housing (see discussion above of FIG. 1B).

For example, the belt 106 in FIG. 20 includes three visual alignment guide lines 166 on an upper surface of the belt 106, although more or less than three lines 166 may be included. The visual alignment guide lines 166 may extend parallel to the rollers 118, 120 (see FIG. 4) to ensure an edge of the transfer sheet is placed parallel to the rollers 118, 120 when it is attached to the belt 106 for inserting the sheet into the housing. As illustrated in FIG. 20, the visual alignment guide lines 166 may extend the majority of the length of the rollers 118, 120. The visual alignment guide lines 166 may be styled to be consistent with other features of the transfer device 100.

Referring still to FIG. 20, the exposed outer edges 168 of the belt 106 may be hemmed or otherwise protectively finished with a reinforcement structure, e.g., by a coating or sealing that resists abrasion. A raw edge of the belt 106 is prone to friction and fraying and is vulnerable to wear over time, especially in instances where the belt 106 migrates and rubs against the deck 130, 132. The hemmed/protected edges 168 improve the life of the belt 106 and mitigate aesthetic and/or functional issues, such as edge fraying. The hemmed edges 168 may provide resistance to belt migration by changing belt circumference sizing (or length) between the center 170 and the edges 168 of the belt 106 (i.e., providing tension on the edges 168 while maintaining a looser center region 170 with relatively less tension for improved function). The hemmed edges 168 may be on the inside or outside surface of the belt 106, and may be formed from the same material as the belt 106 or a different material.

The belt 106 may include a low friction interior surface or lining 172 to reduce drag on the deck 130, 132. The interior surface 172 may include a low friction surface finish (e.g., a selected polymer or optimized thermoplastic material), texture, or covering (e.g., nylon impregnated with TEFLON® or silicone material) to reduce static and dynamic coefficients of friction. Additionally or alternatively, the interior surface 172 may be configured to interact with the outer surfaces of the deck 130, 132 to promote low friction. For example, pattern interaction between the interior surface 172 of the belt 106 and the outer surfaces of the deck 130, 132 may provide low friction between the respective surfaces. Thus, the belt 106 moves on the deck; otherwise, the deck has substantially no moving parts in transfer of a body.

In some embodiments, the deck 130, 132 may be coated in order to reduce friction with moving belt 106, or another reduced friction surface may be used. Suitable coating and surface finishing techniques for reduced friction surfaces include, but are not limited to, powder coating (e.g., a free-flowing, dry powder coating technique), textured surface applications, film coating, vapor deposition, spraying, and other coating and surfacing techniques selected for reduced friction, durability and other properties. Transfer belt 106 also may be provided with a reduced friction (e.g., inner) surface or layer, for example a silicone impregnated nylon or other material, which is selected to reduce friction along the interface between transfer belt 106 and the facing surfaces of the deck 130, 132.

Sealed Perimeter Edge of Housing

Figure 9:
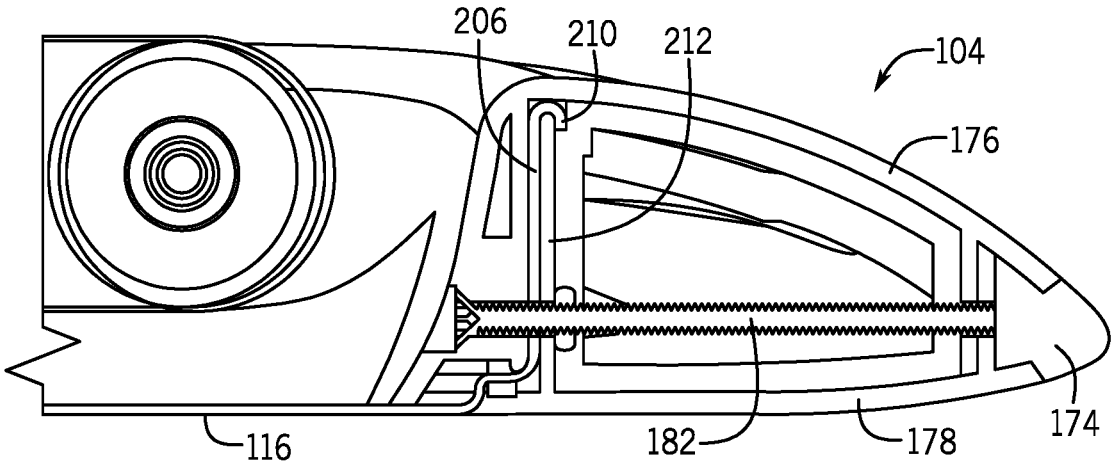
FIG. 9 is a detail, cross-sectional view of the transfer device, according to the embodiment of FIG. 1.

FIG. 9 is a detail, cross-sectional view of the transfer device, e.g., according to the embodiment of FIG. 1. The exterior perimeter edge of the housing 104 may be sealed to reduce the risk of entry and harboring of contaminants, in particular contaminating fluids such as blood or urine, along unsealed, seamed edges. The design of the housing 104 and/or certain hardware may be used to ensure a tight fitment along the perimeter of the housing 104.

Referring to FIG. 9, the housing 104 may include a perimeter gasket or elastic bumper 174 to ensure a tight fitment along the perimeter of the housing 104. For example, the perimeter gasket 174 may seal the interface between two housing portions, such as an upper housing shell 176 and a lower housing shell 178, of the housing 104. The perimeter gasket 174 may be made from an elastomeric material. In some embodiments, the perimeter gasket 174 may have a Shore A hardness from 10 to 100.

Figure 10:
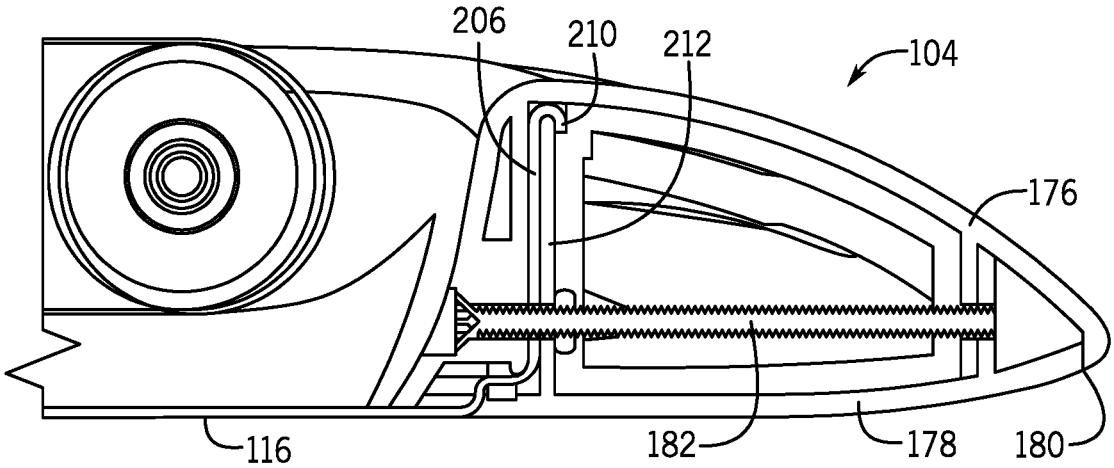
FIG. 10 is a detail, cross-sectional view of the transfer device, according to an alternate embodiment of the present disclosure.

FIG. 10 is a detail, cross-sectional view of the transfer device, according to an alternate embodiment of the present disclosure. Referring to FIG. 10, in an alternative configuration, the housing shells 176, 178 may be designed to form a fluid-tight contact fit between the housing shells 176, 178, thereby forming a sealed or sealable edge 180 extending around a perimeter of the housing 104. The sealed edge 180 may be of the same material as the housing shells 176, 178 (such as plastic), or an elastomeric material with, for example, a Shore A hardness ranging from 10 to 100.

The housing shells 176, 178 may be coupled together via a fastener 182, for example. The fastener 182 may fix the housing shells 176, 178 together to ensure the perimeter gasket 174 or the sealed edge 180 maintain a sealed interface between the housing shells 176, 178 to reduce the risk of entry and harboring contaminants along the exterior perimeter edge of the housing 104.

Gasketed Seams Between Housing Shell and Bottom Panel

Figure 11:
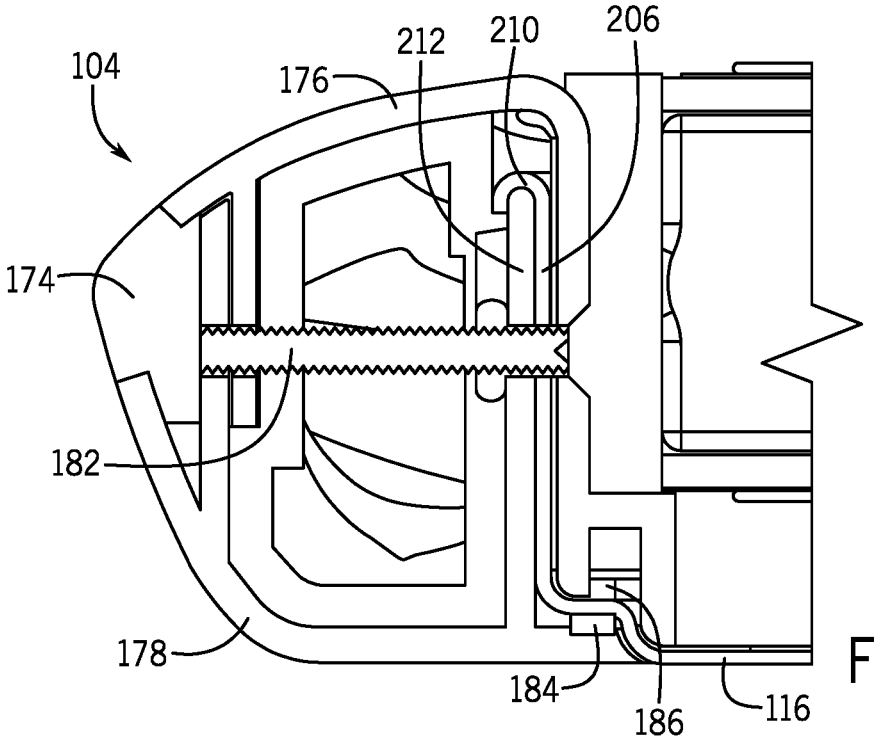
FIG. 11 is a detail, cross-sectional view of the transfer device, according to the embodiment of FIG. 1.
Figure 12:
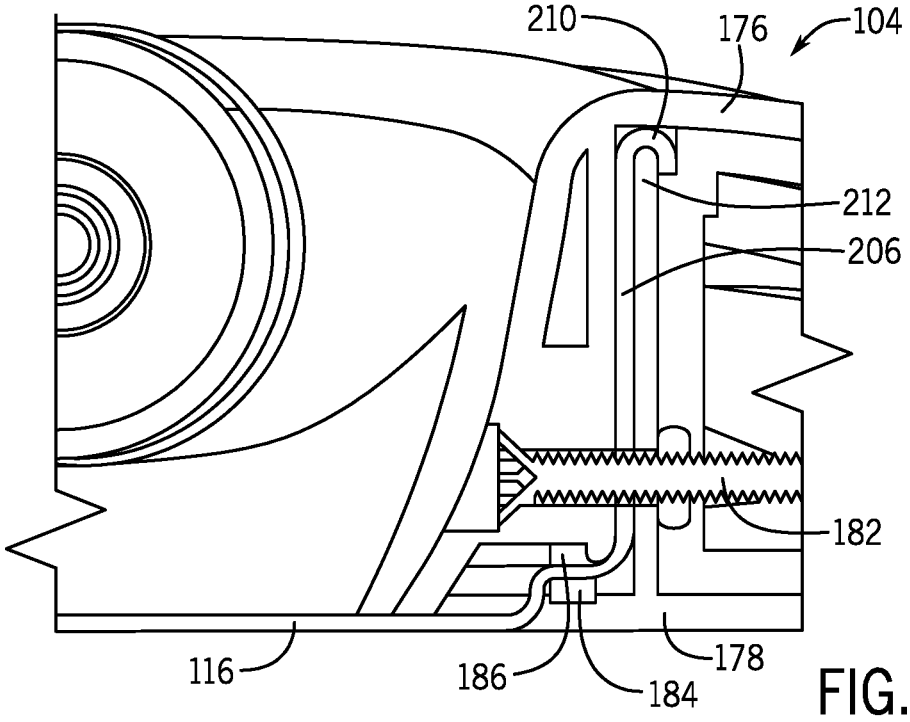
FIG. 12 is a detail, cross-sectional view of the transfer device, according to the embodiment of FIG. 1.

FIG. 11 is a detail, cross-sectional view of the transfer device, e.g., according to the embodiment of FIG. 1. FIG. 12 is a detail, cross-sectional view of the transfer device, e.g., also according to the embodiment of FIG. 1.

Seams present a risk of entry and harboring of fluid and other contaminants therein and generally are not easily cleanable. Referring to FIGS. 11 and 12, the housing 104 may include one or more gaskets at externally-exposed seams formed between the bottom panel or pan 116 and one or both of the housing shells 176, 178.

As illustrated in FIGS. 11 and 12, the housing 104 may include a first gasket 184 positioned between and sealingly engaged with the bottom panel 116 and the lower housing shell 178 to prevent contaminants from entering into the housing 104 through a seam formed between the bottom panel 116 and the lower housing shell 178. The housing 104 may include a second gasket 186 positioned between and sealingly engaged with the bottom panel 116 and the upper housing shell 176 to prevent contaminants from entering into the housing 104 through a seam formed between the bottom panel 116 and the upper housing shell 176.

The gaskets 184, 186 may extend continuously around opposing surfaces of the bottom panel 116 to form a continuous seal between the bottom panel 116 and the lower and upper housing shells 178, 176, respectively. The gaskets 184, 186 may effectively seal off contamination access points, thereby allowing the seams to be cleaned using conventional methods. The gaskets 184, 186 may be made from an elastomeric material. In some embodiments, the gaskets 184, 186 are made from an elastomeric material with a Shore A hardness ranging from 5 to 100.

Impact Resistant Corners

Figure 5:
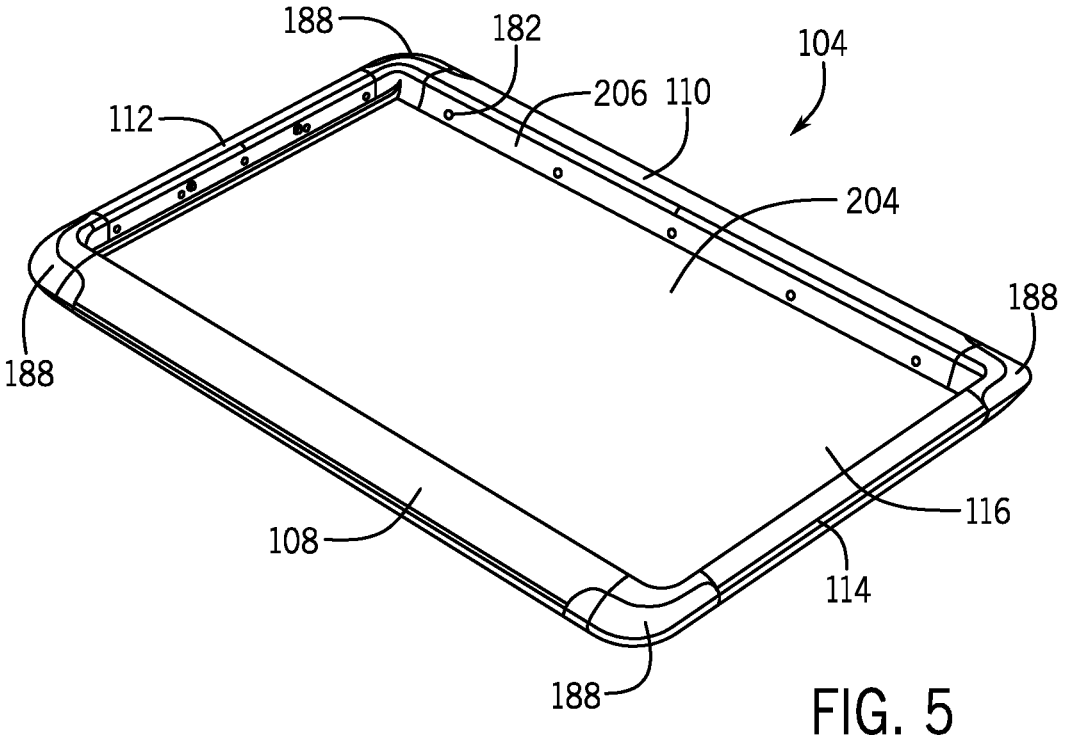
FIG. 5 is a perspective view of a housing of the transfer device, according to the embodiment of FIG. 1.

FIG. 5 is a perspective view of a housing 14 of the transfer device, e.g., according to the embodiment of FIG. 1. Referring to FIG. 5, the housing 104 may have impact resistant corner bumpers 188. The corner bumpers 188 are less prone to damage than the housing shells 176, 178 (see FIGS. 9-12) and increase the ability to take impact or absorb impact energy without significant damage. By providing impact and abrasion protection at the corners and edges of the housing 104, the corner bumpers 188 significantly reduce damage from mishandling or impact by transferring energy to the structural part of the transfer device 100 (e.g., the panel 116).

The corner bumpers 188 may be formed from durable impact-absorbing elastomeric materials, such as self-skinning foams and/or rubber-like compounds with, for example, a Shore A hardness ranging from 10 to 100 (e.g., latex free). The materials used for forming the corner bumpers 188 may have similar texture and hardness features as the housing shells 176, 178 to reduce the risk of skin drag across the surface of the corner bumpers 188.

Figure 13:
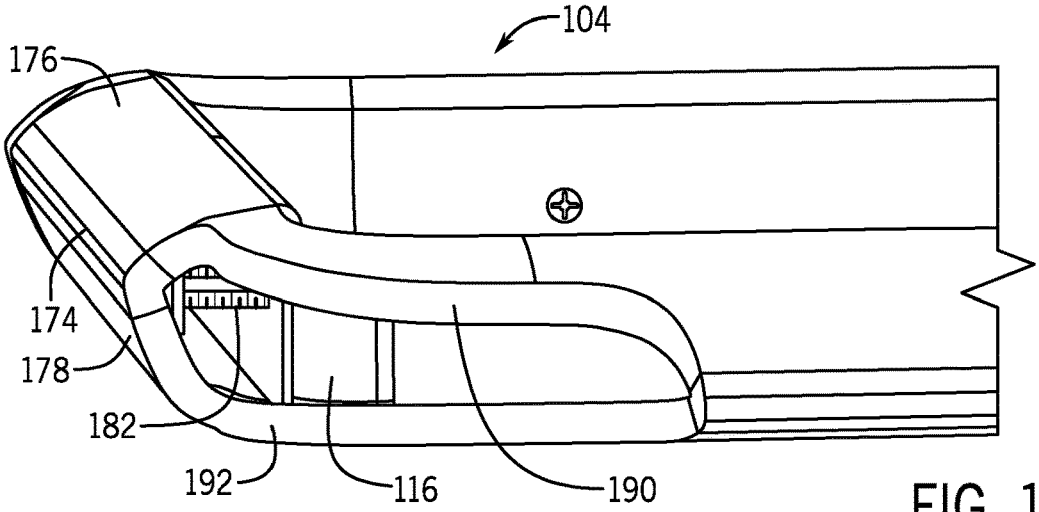
FIG. 13 is a perspective view of the housing without a corner bumper, according to the embodiment of FIG. 5.

FIG. 13 is a perspective view of the housing 104 without a corner bumper, e.g., according to the embodiment of FIG. 5. Referring to FIG. 13, the housing 104 is shown without one of the corner bumpers.

As illustrated in FIG. 13, the perimeter gasket or bumper 174 extends along the outer edge of the housing 104 to form a sealed interface between the upper housing shell 176 and the lower housing shell 178. One or more fasteners 182 may extend at least partially through the housing shells 176, 178 and the bottom panel 116 to couple the shells 176, 178 and panel 116 together (see FIGS. 11-17).

Figure 14:
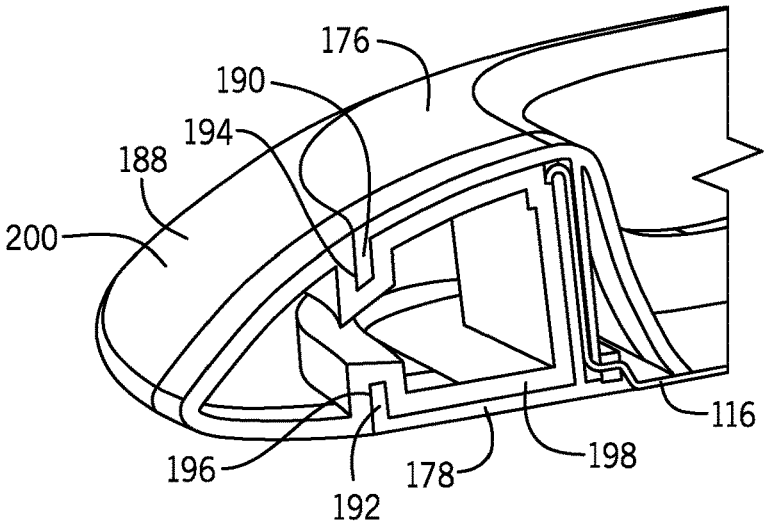
FIG. 14 is a detail, cross-sectional view of the housing, according to the embodiment of FIG. 5.
Figure 15:
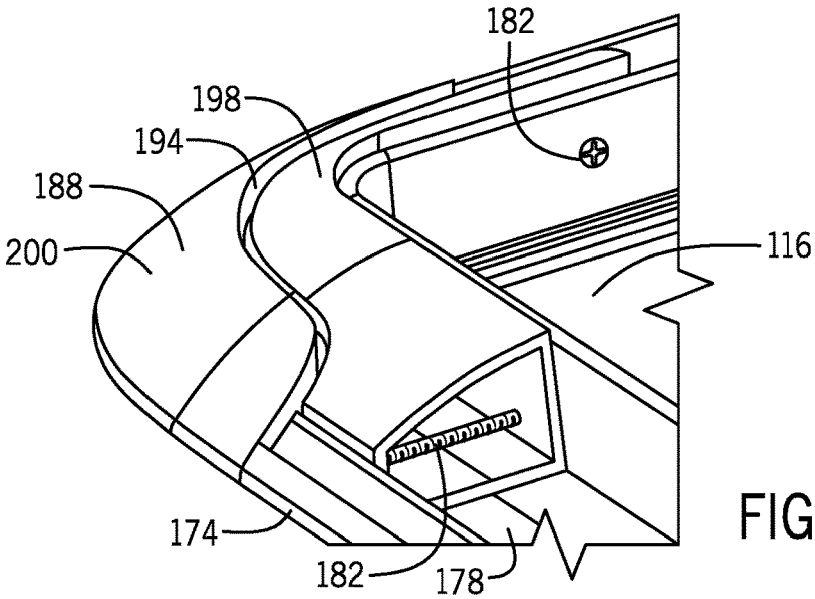
FIG. 15 is a detail, perspective view of the housing with the upper housing shell removed, according to the embodiment of FIG. 5.

FIG. 14 is a detail, cross-sectional view of the housing 104, e.g., according to the embodiment of FIG. 5. FIG. 15 is a detail, perspective view of the housing 104 with the upper housing shell 176 removed, e.g., also according to the embodiment of FIG. 5.

Referring to FIGS. 14 and 15, the corner bumpers 188 may be integrated with the housing shells 176, 178. For example, the housing shells 176, 178 may define flanges 190, 192, respectively, for attaching the corner bumper 188 to the housing shells 176, 178. The flanges 190, 192 may extend toward each other and may be received in grooves 194, 196, respectively, formed in upper and lower surfaces of the corner bumper 188 to retain the corner bumper 188 to the upper and lower shells 176, 178.

A retention portion 198 of the corner bumper 188 may be received between the housing shells 176, 178, and a bumper portion or projection 200 of the corner bumper 188 may extend outwardly from the retention portion 198 and may be exposed to absorb impact on the respective corner of the transfer device 100. The retention portion 198 and the bumper projection 200 may be demarcated from each other by the grooves 194, 196.

As illustrated in FIG. 15, one or more fasteners 182 may fasten the corner bumper 188 to the bottom panel 116, the lower housing shell 178, and the upper housing shell 176 (removed in FIG. 15 to show the corner bumper 188 positioned relative to the lower housing shell 178 and the bottom panel 116). In some embodiments, the corner bumpers 188 are specifically designed to contact the bottom panel 116 to disperse impact energy across a larger surface area (e.g., across the panel 116), as opposed to being localized at the point of impact (e.g., relying on an elastic-inelastic impact scenario).

Rigidity and Structure of Housing

Figure 6:
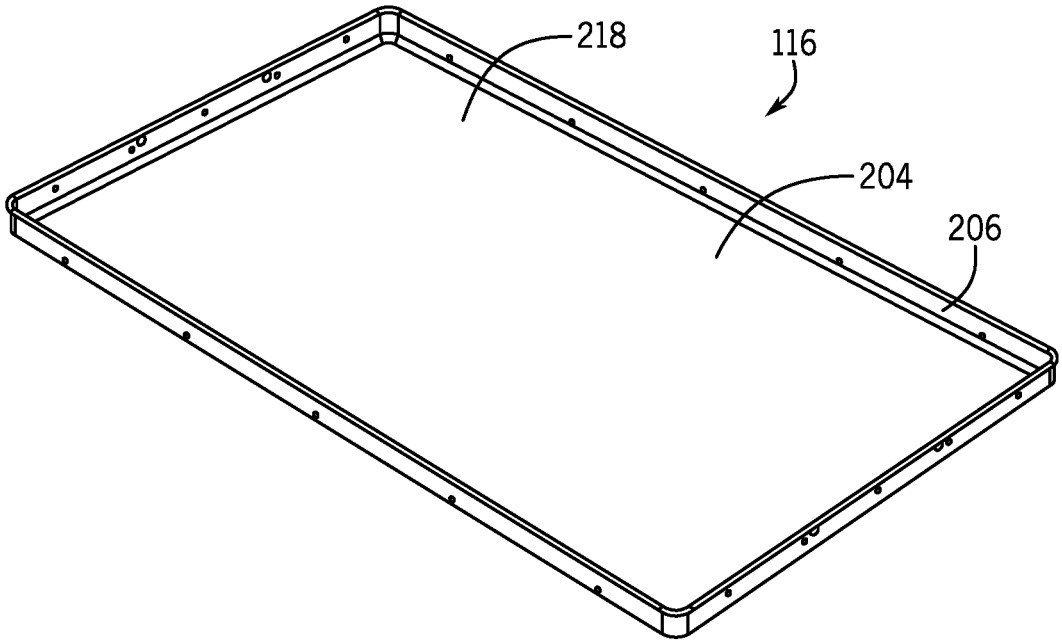
FIG. 6 is a perspective view of a structural panel of the support device, according to the embodiment of FIG. 5.
Figure 7:
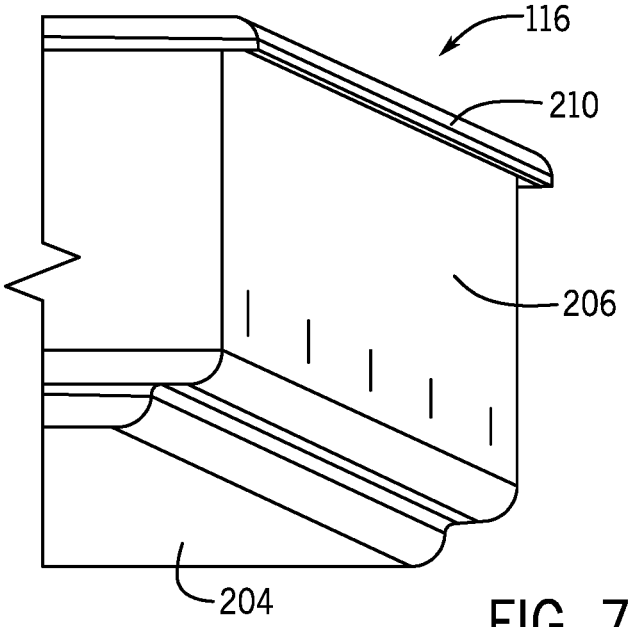
FIG. 7 is a detail view of a portion of the structural panel, according to the embodiment of FIG. 6.
Figure 8:
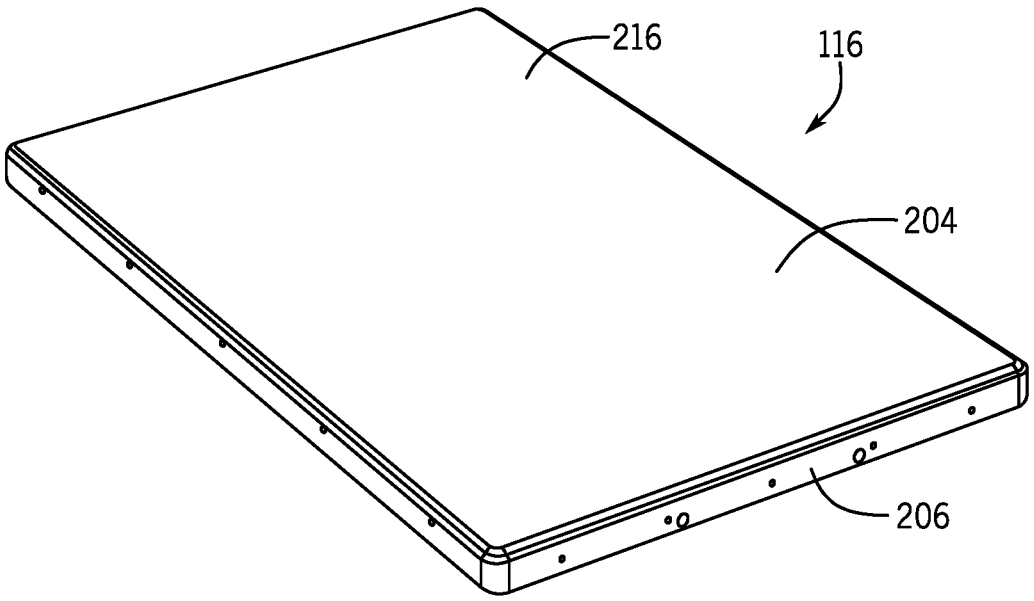
FIG. 8 is another perspective view of the structural panel, according to the embodiment of FIG. 6.

FIG. 6 is a perspective view of a structural panel 116 of the support device, e.g., according to the embodiment of FIG. 5. FIG. 7 is a detail view of a portion of the structural panel 116, e.g., according to the embodiment of FIG. 6. FIG. 8 is an alternate perspective view of the structural panel 116, e.g., also according to the embodiment of FIG. 6. The rigidity and structure of the transfer device 100 is provided, in part, by the bottom panel 116.

As illustrated in FIGS. 5-8, the bottom panel 116 includes a base 204 with circumferential reinforcement, in one embodiment a structural side wall 206 extending upwardly from the entire perimeter of the base 204, thereby resembling a pan. The side wall 206 may be oriented substantially perpendicular to the base 204, which may be planar.

Figure 21A:
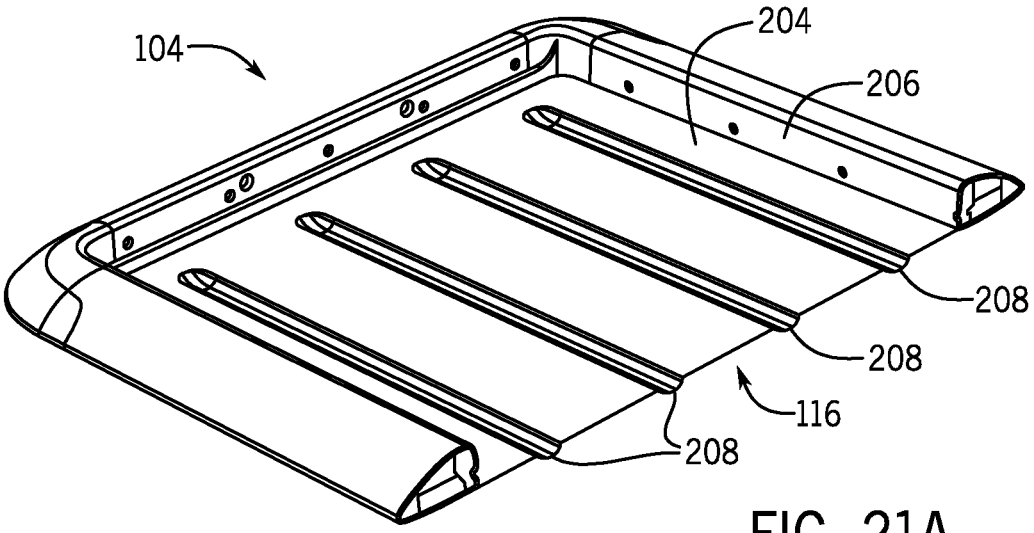
FIG. 21A is a perspective view of a housing of the transfer device, according to the embodiment of FIG. 5 and including ribs.
Figure 21B:
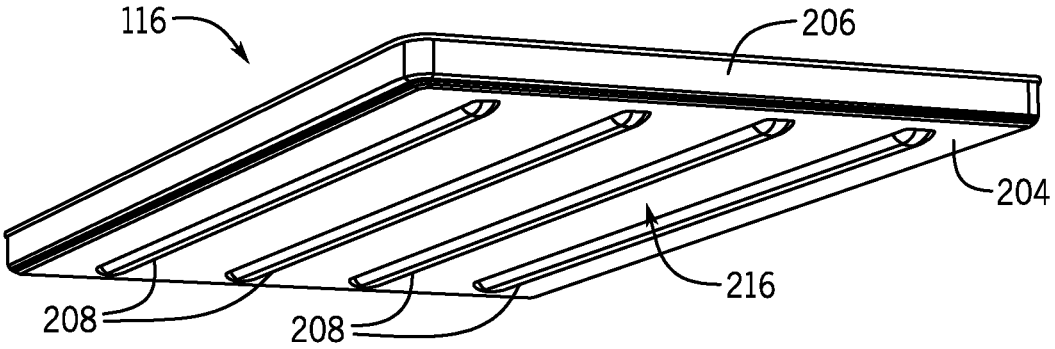
FIG. 21B is a perspective view of a structural panel of the transfer device, according to the embodiment of FIG. 21A.

FIG. 21A is a perspective view of a housing 104 of the transfer device, e.g., according to the embodiment of FIG. 5 and including ribs 208. FIG. 21B is a perspective view of a structural panel 116 of the transfer device, e.g., according to the embodiment of FIG. 21A.

As illustrated in FIGS. 21A and 21B, the base 204 may include ribbing to provide additional stiffness to the panel 116 suitable to maintain clearance between the base 204 and a bottom-side of the deck assembly 102 during patient transfer. The base 204 may include a plurality of elongate ribs 208 extending lengthwise along a length direction of the housing 104.

The ribs 208 may be spaced apart from each other across a lateral direction of the housing 104. The ribs 208 may project downwardly from the base 204, so that the ribs 208 do not reduce the nominal clearance between the panel 116 and the deck assembly 102. The ribs 208 may be configured to reduce deflection of the base 204 in a weight-efficient manner, thereby limiting interference between the base 204 and the deck assembly 102 during patient transfer with a minimal to no increase in the weight of the housing 104.

The ribs 208 may have various dimensions. In one embodiment, the ribs 208 have a width sufficient to provide finger-width access for cleaning (such as at least three-quarters of an inch wide, or 1.9 cm), and the ribs 208 have a depth that minimally increases or does not increase the overall profile of the transfer device 100 (such as a depth of approximately one-quarter of an inch, or 0.6 cm).

The ribs 208 may prevent the housing 104 from shifting during patient transfer. The geometric shape of the ribs 208 may be configured to inhibit the housing 104 from shifting. The ribs 208 may provide a physical impediment to shifting of the transfer device 100, because the ribs 208 may project perpendicular to transfer forces applied during patient transfer and may bear into a yielding underlying surface, such as a mattress or foam table under pad, under the weight of the patient.

The ribs 208 may be provided in combination with other features that inhibit shifting, such as low-friction movement of the belt 106 and the rollers 118, 120 (which reduce lateral forces on the housing 104 that promote shifting), and surface treatment applied to the outward-facing surface 216 (e.g., bottom surface) of the bottom panel 116. Part or all of the outward facing surface 216 of the panel 116 may be configured with a surface treatment or material with a high friction characteristic (e.g., a high coefficient of friction).

In one embodiment, the projecting ribs 208 may include a high-friction coating or treatment to further inhibit lateral shifting of the housing 104. In another embodiment, the entire outward-facing surface 216 of the panel 116 may include a high-friction coating or treatment to inhibit lateral shifting of the housing 104. Although four ribs 208 are illustrated in the embodiment in FIGS. 21A and 21B, the base 204 may include more or less than four ribs.

Existing transfer devices include a frame with various components, and the panel 116 with its circumferential reinforcement eliminates the use of such frame, which reduces the overall weight of the transfer device 100 without affecting, and potentially improving, the stiffness function of this core component for weight-bearing during transfers. The panel 116 may be formed, stamped, casted, or molded, for example. The panel 116 may be made of metal, plastic, a combination of metal and plastic, or other compounds or polymers capable of forming structurally integrated side walls 206. The flexural modulus of the material used to form the panel 116 may have a minimum of 0.1 GPA. The panel 116 may have less than a 10 mm deflection at any point across its downward facing surface.

As illustrated in FIG. 7, a lip 210 may be formed along an upper edge of the panel side wall 206. The lip 210 may facilitate placement of the panel 116 relative to the frame members 108, 110, 112, 114 (see FIG. 4) and also strengthen the rigidity of the side wall 206 and the panel 116 itself.

For example, as illustrated in FIGS. 9-12, the lip 210 at the top of the side wall 206 of the panel 116 may be disposed over an upright wall 212 of the lower housing shell 178 and may be captured between the housing shells 176,178. The side wall 206 and the upright wall 212 may be parallel to and contact each other. One or more fasteners 182 may extend through the side wall 206 of the panel 116 and the housing shells 176,178 to secure the panel 116 and housing shells 176, 178 together such that the panel 116 provides structural rigidity to the transfer device 100.

Connection Hardware

Referring to FIGS. 1-3, the transfer device 100 includes no visible exterior hardware or protrusions. In other words, all exterior exposed hardware and rubber feet or rests have been eliminated in the transfer device 100 to reduce available contaminant access and accumulation points.

As illustrated in FIG. 5, the components of the housing 104 (e.g., housing shells and structural panel) may be connected together by using fasteners 182 inserted through the wall 206 of the panel 116 at a plurality of mechanical connection points adapted for assembly of the housing. The fasteners 182 may be accessible from an interior of the housing 104, and are not visible at an exterior of the housing 104.

As illustrated in FIGS. 9-12, the fasteners 182 may be horizontally-oriented and may penetrate vertical walls of the upper housing shell 176, the lower housing shell 178, and the bottom panel 116, thereby joining the upper housing shell 176, the lower housing shell 178, and the bottom panel 116 together into a uniform, relatively rigid structure.

Friction Character of Panel

Referring to FIG. 8, part or all of the outward-facing (e.g., bottom) surface 216 of the panel 116 is configured with a surface treatment or material with a high friction characteristic (e.g., a high coefficient of friction) that prevents the transfer device 100 from moving relative to the first surface and second surface during use. Existing devices include elastomeric feet disposed around the sides of the device, and the high friction characteristic of the panel 116 eliminates these elastomeric feet from transfer device 100. A damage-resistant coating may be applied to the outward facing surface 216 of the panel 116 to protect the surface 216 from damage.

The bottom surface 216 of the panel 116 may include a high friction material (e.g., rubber or similar elastomer) in order to hold the housing 104 substantially stationary during transfer of a patient from one surface to another, as described herein. Thus, in normal operation, the housing 104 does not travel with the patient (or other body) during the transfer process, as in some other (e.g., roller board) designs. Instead, the patient and the underlying sheet move with rotation of the belt 106.

The term "substantially stationary," therefore, as used with respect to transfer device 100 and housing 104 herein, indicates that at least a portion of housing 104 remains in contact with a first (starting) surface, and at least another portion of housing 104 remains in contact with a second (destination) surface during the patient transfer process. The portions of the transfer device 100 in contact with the respective initial and final surfaces may include, but are not limited to, one or more sides of housing 104 (e.g., along side frame 108 and/or side frame 110), and/or the bottom panel 116. The bottom surface of the panel 116 is configured to hold the transfer device 100 substantially stationary with respect to at least one of the first and second surfaces during transfer of a patient.

Referring to FIGS. 4 and 6, the interior (e.g., top) surface 218 of the panel 116 has a low friction treatment or material characteristic (e.g., with a low coefficient of friction) to ensure the belt 106 and an associated transfer sheet have an impediment-free rotational movement relative to the panel 116. The interior surface 218 of the panel 116 may have a low friction surface finish (e.g., a selected polymer or optimized thermoplastic material), texture, or covering (e.g., nylon impregnated with TEFLON® or silicone material) to reduce static and dynamic coefficients of friction.

The transfer device 100 provides multiple advantages over existing transfer devices. For example, the transfer device 100 has a reduced overall weight as compared to existing transfer devices, thereby making it easier for nurses and/or other medical staff to move the transfer device 100 and transfer patients from a first (initial) surface to a second (destination) surface.

The transfer device 100 has a reduced damage risk to the device 100 relative to existing transfer devices. For example, the transfer device 100 has corner bumpers and/or a perimeter gasket that provides impact protection to the transfer device 100.

The transfer device 100 provides a reduced risk of viral/bacterial contamination. For example, the transfer device 100 provides sealed seams and interfaces between its various components and eliminates exterior connection or other protruding hardware, thereby reducing contamination access points into the transfer device 100 and facilitating cleaning.

The transfer device 100 has a reduced number of components, thereby making the transfer device 100 easier to manufacture and assemble. For example, the transfer device 100 does not include a separate structural support frame, and rather includes a bottom panel with a structural side wall that functions as the bottom of the transfer device 100 as well as provides structural rigidity to the transfer device 100.

The transfer device 100 reduces device migration and stays across gap between the first surface and second surface during patient transfer. For example, the transfer device 100 includes a high friction bottom surface, without positioning feet, that provides a slip resistant surface to ensure the transfer device 100 does not move inadvertently during patient transfer.

The transfer device 100 reduces belt migration on the rollers. For example, the transfer device 100 includes a belt with hemmed edges that restrict the belt from inadvertent migration.

Transfer Methods

The patient transport system or transfer device 100 is used with methods for patient transfer that benefit from its structure. These include: a method for transferring a patient from a first surface to a second surface, the method comprising: spanning a gap between the first surface and the second surface with a transfer device, the device comprising a housing with first and second opposing sides coupled to first and second opposing ends and a panel having a circumferential reinforcement coupled to the first and second opposing sides and the first and second opposing ends to provide structural rigidity to the transfer device when loaded with a patient moving across the gap, the first surface proximate the first side and the second surface proximate the second side; and moving the patient from the first surface to the second surface on disposable sheet affixed to a continuous belt disposed about a deck spanning the gap and positioned at least partially within and supported by the housing.

In this method the panel may contact the first and second surfaces along a bottom surface frictional feature adapted to maintain a position of the transfer device relative to the first and second surfaces while the patient is moving. In this method the transfer device may include a sealed exterior perimeter adapted to seal the housing against fluid and other contaminant entry.

This method may further comprise a step of inserting the disposable sheet at least partially into the housing before loading the patient on the device and performing the moving. This method may also further comprise removing the deck from the housing and reversing an orientation thereof, wherein the deck is disposed within the housing with top and bottom surfaces of the deck reversed. This method may further comprise spanning a gap between the first and second surfaces with the transfer device, wherein the patient is supported by the housing and travels on and with the disposable sheet in moving the patient from the first surface to the second surface across the gap.

This method may also further comprise rotating first and second elongated rollers disposed with the continuous belt along opposing sides of the deck, wherein the continuous belt is rotationally engaged with the first and second elongated rollers in transferring the patient from the first surface to the second surface and wherein the first and second elongated rollers are spaced from the opposing sides of the deck by a tolerance that increases from opposing ends of the deck to a middle portion thereof, the tolerance selected to maintain clearance for flexing of the rollers and/or housing in transferring the patient from the first surface to the second surface on the continuous belt.

While this invention has been described with reference to exemplary embodiments, it will be understood by those skilled in the art that various changes can be made and different equivalents may be substituted for particular elements thereof, without departing from the spirit and scope of the invention. The invention is thus not limited to the particular examples that are disclosed, and can also be adapted to different problems and situations, and applied with different materials and techniques, without departing from the essential scope of embodiments encompassed by the appended claims.

The invention claimed is:

1. A transfer device comprising:

a housing comprising first and second opposing sides coupled to first and second opposing ends, with an upright wall extending from a lower portion of the housing toward an upper portion of the housing and the ends dimensioned for the housing to span a distance between a first surface proximate the first side and a second surface proximate the second side; and a base panel attached to the first and second opposing sides and the first and second opposing ends of the housing, the base panel having a circumferential reinforcement with a side wall extending adjacent the upright wall and configured for providing structural stiffness to the housing;

a deck positioned at least partially within and coupled to the housing; and a continuous belt disposed for motion about the deck, the continuous belt configured to transfer a body from the first surface proximate the first side of the housing to the second surface proximate the second side of the housing;

wherein the base panel defines base panel component comprising a bottom side of the housing, with the circumferential reinforcement comprising the side wall extending about a perimeter of the base panel component, structurally integrated with the base panel component and coupled to the upright wall of the housing; and wherein the side wall is attached to the first and second opposing sides of the housing, and to the first and second opposing ends of the housing.

2. The transfer device of claim 1, wherein the base panel component comprises a planar base disposed on the bottom side of the housing, with the side wall extending about the perimeter of the base panel component substantially perpendicular to the planar base, and further comprising a lip formed along an upper edge of the side wall and disposed over a top of the upright wall along the first and second opposing sides of the housing, and the first and second opposing ends of the housing.

3. The transfer device of claim 1, further comprising a plurality of mechanical fasteners joining the side wall of the base panel component to the upright wall of the housing along the first and second opposing sides of the housing, and along the first and second opposing ends of the housing.

4. The transfer device of claim 1, wherein each of the first and second sides of the housing comprises a contoured edge region having converging top and bottom slopes selected for ergonomic interaction with the body in transfer thereof from the first surface to the second surface, and further comprising a surface treatment or material providing friction to hold the transfer device substantially stationary with respect to at least one of the first and second surfaces during the transfer of the body.

5. The transfer device of claim 1, further comprising first and second gaskets engaged between upper and lower portions of the housing along opposing surfaces of the base panel component for sealing an exterior perimeter of the housing from entry of fluids or foreign matter, wherein the exterior perimeter of the housing comprises a fluid seal.

6. The transfer device of claim 1, wherein the continuous belt is disposed in a bidirectional conveying relationship about the deck, the continuous belt configured for motion in one direction to insert a transfer sheet into the housing and in an opposite direction to transfer the body from the first surface at the first side of the housing to the second surface at the second side of the housing.

7. The transfer device of claim 1, further comprising one or more impact-resistant corner members adapted to dissipate impact energy incident thereon into the housing, the impact-resistant corner members comprising elastomeric components disposed at one or more corners of the housing.

8. The transfer device of claim 1, further comprising first and second elongated rollers extending along first and second sides of the deck, wherein the first and second elongated rollers are spaced from the first and second sides of the deck by a distance that reduces contact between the first and second elongated rollers and the first and second sides of the deck due to excess deflection of the deck.

9. The transfer device of claim 1, wherein:

the deck comprises substantially symmetric top and bottom major surfaces attachable to end frame members of the housing for release and removal therefrom; and the deck is reversible in disposition within the housing, with respect to the substantially symmetric top and bottom major surfaces and with respect to the end frame members.

10. The transfer device of claim 1, wherein the deck comprises substantially continuous top and bottom surfaces, lacking mechanical fasteners or deck assembly hardware accessible on either the top or bottom surface.

11. The transfer device of claim 10, wherein:

the deck comprises an extruded polymer deck body defining the top and bottom surfaces; or the deck comprises two substantially symmetric panel structures coupled together to define the top and bottom surfaces of the deck with a plurality of integrated structural rib members extending therebetween.

12. The transfer device of claim 1, further comprising one or more of:

a low-friction surface material disposed on an inner portion of the continuous belt, the low-friction surface material selected to reduce friction between the inner portion of the continuous belt and a top surface of the deck;

one or more visual alignment guides disposed on an exposed surface of the continuous belt, the one or more visual alignment guides configured to guide alignment of a transfer sheet placed on the belt and adapted for transferring the body on the continuous belt; and reinforcement structures on one or more outer edges of the continuous belt, wherein the edges are adapted to resist abrasion and provide tensioning to maintain the continuous belt in position with respect to the deck.

13. The transfer device of claim 1, further comprising texturing on one or both of an inner surface of the continuous belt and an outer surface of the deck, the texturing selected to reduce a surface area of contact between the inner surface of the continuous belt and the outer surface of the deck, and to thereby reduce friction between the continuous belt and the deck.

14. The transfer device of claim 1, further comprising a plurality of mechanical connection points adapted for assembly of the housing, wherein the mechanical connection points are disposed along an interior surface of the housing, inaccessible from an exterior of the housing and when assembled the transfer device has no mechanical fastener components exposed on an exterior thereof.

15. A method for transferring a body a first surface to a second surface, the method comprising:

spanning a distance between the first surface and the second surface with a transfer device, the transfer device comprising:

a housing with first and second opposing sides coupled to first and second opposing ends and an upright wall extending from a lower portion of the housing toward an upper portion of the housing, the first surface proximate the first side and the second surface proximate the second side, a base panel having a circumferential reinforcement with a side wall coupled to the first and second opposing sides and the first and second opposing ends of the housing and extending adjacent the upright wall, configured to provide structural rigidity to the housing of the transfer device when loaded with the body, and a continuous belt disposed about a deck positioned at least partially within and supported by the housing; and transferring the body from the first surface to the second surface on the continuous belt, wherein the body is supported across the distance by the deck;

wherein the base panel defines base panel component comprising a bottom side of the housing, with the circumferential reinforcement comprising the side wall extending about a perimeter of the base panel component, structurally integrated with the base panel component and coupled to the upright wall of the housing; and wherein the side wall is attached to the first and second opposing sides of the housing, and to the first and second opposing ends of the housing.

16. The method of claim 15, wherein first and second gaskets are engaged between opposing surfaces the base panel component and upper and lower portions of the housing, respectively, the gaskets adapted to seal a perimeter of the housing against fluid or contaminant entry.

17. The method of claim 15, further comprising positioning the transfer device in contact with the first and second surfaces along a frictional surface defined on a bottom of the base panel component, the frictional surface adapted to maintain a position of the transfer device with respect to the first and second surface, while transferring the body.

18. The method of claim 15, further comprising attaching a sheet of material to the continuous belt and inserting a portion of the sheet of material into the housing on the continuous belt, wherein the body is supported by the deck on the sheet of material attached to the continuous belt, while transferring the body.

19. The method of claim 18, further comprising removing the deck from the housing, reversing an orientation of the deck, and repositioning the deck at least partially within and supported by the housing, wherein the top and bottom surfaces or opposing sides or ends of the deck are reversed.

20. The method of claim 15, further comprising:

engaging first and second elongated rollers within the continuous belt, wherein the first and second rollers are spaced from opposing sides of the deck by a tolerance that increases from opposing ends to a middle portion thereof; and rotationally engaging the belt with the first and second elongated rollers, wherein the tolerance maintains clearance between the elongated rollers and the opposing sides of the deck upon flexing thereof, while transferring the body from the first surface to the second surface supported by the deck.

21. The method of claim 15, wherein the housing comprises an upper housing portion and a lower housing portion, with the side wall mechanically attached to each of the upper and lower portions of the housing at the first and second opposing sides, and at the first and second opposing ends.

22. The method of claim 15, wherein the housing comprises an upright wall extending adjacent the side wall from a lower portion of the housing toward an upper portion of the housing, and engaged with an upper edge of the side wall.

* * * * *